US011448211B2

(12) United States Patent
Sakai et al.

(10) Patent No.: US 11,448,211 B2
(45) Date of Patent: Sep. 20, 2022

(54) OIL PUMP INCLUDING GAP BETWEEN FLANGE PORTION OF TUBULAR CORE AND FLANGE-OPPOSING PORTION OF RESIN HOUSING

(71) Applicant: TOYODA GOSEI CO., LTD., Kiyosu (JP)

(72) Inventors: Shinya Sakai, Kiyosu (JP); Seongjun Park, Yokohama (JP); Takeshi Hattori, Kiyosu (JP)

(73) Assignee: TOYODA GOSEI CO., LTD., Aichi-pref. (JP)

( * ) Notice: Subject to any disclaimer, the term of this patent is extended or adjusted under 35 U.S.C. 154(b) by 498 days.

(21) Appl. No.: 16/547,959

(22) Filed: Aug. 22, 2019

(65) Prior Publication Data

US 2020/0072214 A1 Mar. 5, 2020

(30) Foreign Application Priority Data

Aug. 31, 2018 (JP) ..... JP2018-163625
Apr. 26, 2019 (JP) ..... JP2019-086356

(51) Int. Cl.
*F01C 1/10* (2006.01)
*F03C 2/00* (2006.01)
(Continued)

(52) U.S. Cl.
CPC ..... *F04C 2/102* (2013.01); *F04C 15/0026* (2013.01); *F04C 2230/601* (2013.01);
(Continued)

(58) Field of Classification Search
CPC ..... F04C 2/102; F04C 2/103; F04C 15/00; F04C 15/0026; F04C 2230/601;
(Continued)

(56) References Cited

U.S. PATENT DOCUMENTS 5,862,664 A * 1/1999 Ohashi ..... F04C 15/0023 418/135
6,039,551 A * 3/2000 Takeuchi ..... F04C 2/086 418/88
(Continued)

FOREIGN PATENT DOCUMENTS

CN 103503287 A 1/2014
CN 108138766 A 6/2018
(Continued)

OTHER PUBLICATIONS

Chinese Office Action dated Mar. 15, 2021, issued in corresponding Chinese Patent Application No. 201910801954.5 (and English Machine Translation).
(Continued)

*Primary Examiner* — Theresa Trieu
(74) *Attorney, Agent, or Firm* — Posz Law Group, PLC

(57) ABSTRACT

An oil pump includes: a first core in which an inner rotor having external teeth and an outer rotor having internal teeth are housed; a housing having a recess in which the first core is held; a second core disposed in contact with the first core in an axial direction; and a cover having a holding hole in which the second core is held. The first core has a first recess/projection portion formed on a first axial end surface at a side opposite to an axial end surface opposing a bottom wall of the recess. The second core has a second recess/projection portion formed on a second axial end surface that is in contact with the first axial end surface. A gap is formed between opposing surfaces of the housing and the cover in a state where the first and second axial end surfaces are in contact with each other.

7 Claims, 16 Drawing Sheets

(51) Int. Cl.

| | |
|---|---|
| ***F03C 4/00*** | (2006.01) |
| ***F04C 2/00*** | (2006.01) |
| ***F04C 2/10*** | (2006.01) |
| ***F04C 15/00*** | (2006.01) |

(52) U.S. Cl.
CPC .... *F04C 2230/602* (2013.01); *F04C 2240/30* (2013.01); *F04C 2240/805* (2013.01); *F05C 2225/00* (2013.01)

(58) Field of Classification Search
CPC ..... F04C 2230/602; F04C 224/10; F04C 224/20; F04C 224/30; F04C 224/805; F05C 2225/00
See application file for complete search history.

(56) References Cited

U.S. PATENT DOCUMENTS

| | | | | |
|---|---|---|---|---|
| 9,810,215 | B2 | 11/2017 | Ishii et al. | |
| 2014/0091645 | A1 | 4/2014 | Takayoshi et al. | |
| 2015/0132172 | A1* | 5/2015 | Reimann | F04C 2/10 418/131 |
| 2015/0204325 | A1 | 7/2015 | Ishii et al. | |
| 2016/0348675 | A1* | 12/2016 | Ishii | F04C 15/06 |
| 2018/0274539 | A1 | 9/2018 | Hiroshi et al. | |

FOREIGN PATENT DOCUMENTS

| | | | |
|---|---|---|---|
| JP | 2001-182669 | A | 7/2001 |
| JP | 2006-329054 | A | 12/2006 |
| JP | 2013-163988 | A | 8/2013 |
| JP | 2014-51964 | A | 3/2014 |
| JP | 2017-066976 | A | 4/2017 |

OTHER PUBLICATIONS

Notice of Reasons for Refusal dated May 17, 2022 in corresponding JP Patent Application No. 2019-086356 (with machine English translation).

* cited by examiner

OIL PUMP INCLUDING GAP BETWEEN FLANGE PORTION OF TUBULAR CORE AND FLANGE-OPPOSING PORTION OF RESIN HOUSING

TECHNICAL FIELD

The present invention relates to an oil pump.

BACKGROUND ART

Hitherto, a trochoid type oil pump has been known (for example, JP2014-51964(A) and JP2017-66976(A)). The oil pump includes an inner rotor, an outer rotor, a housing, and a cover. The inner rotor is fixed to a drive shaft and has external teeth. The outer rotor has internal teeth that mesh with the external teeth of the inner rotor. The inner rotor is rotatable in a state where the inner rotor is eccentric to the outer rotor. The housing has a recess in which the inner rotor and the outer rotor are housed. The cover is disposed in an axial direction with respect to the housing and closes the recess of the housing.

In the oil pump disclosed in JP2014-51964(A), the inner rotor, the outer rotor, and the cover are each formed from a metal. In addition, at least a part of the housing is formed from an injection-molded resin. According to the structure of the oil pump, size reduction is achieved as compared to a structure in which the entire housing is formed from a metal.

The oil pump disclosed in JP2017-66976(A) includes a metallic core having a housing portion in which the inner rotor and the outer rotor are housed. The core is insert-molded in a housing made of a resin and is disposed in a recess of the housing. The housing portion of the core and the recess of the housing are closed by a metallic cover.

SUMMARY OF INVENTION

Technical Problem

However, in the oil pump, unless the dimension of each component is appropriately managed, the following inconvenience arises. Specifically, if the dimension of each component is managed in a favorable manner, when the recess of the housing is closed by the cover no undesired gaps are formed between the inner and outer rotors, and the cover, and desired accuracy in assembling is ensured. Thus, an effective capacity for oil to be retained is constant, and a stable discharge amount is ensured. On the other hand, if the dimension of each component is poorly managed, when the recess of the housing is closed by the cover, gaps may be formed between the inner and outer rotors, and the cover, and thus the accuracy in assembling decreases. Therefore, the effective capacity for oil to be retained varies, and a stable discharge amount is not ensured.

Meanwhile, in order to obtain a favorable state of the dimension of each component, forming each component from a metal and performing cutting on each component are considered. However, if each component is formed from a metal, the weight of the entire oil pump increases, and if cutting needs to be performed on each component, time and effort are taken in manufacturing.

The present invention has been made in view of such problems, and an object of the present invention is to provide an oil pump that ensures desired accuracy in assembling each component while achieving size reduction.

Solution to Problem

An aspect of the present invention is directed to an oil pump including: an inner rotor having external teeth; an outer rotor having an inner rotor housing portion in which the inner rotor is rotatably housed in an eccentric state, and internal teeth that mesh with the external teeth; a tubular first core having a rotor housing portion in which the inner rotor and the outer rotor are housed; a housing made of a resin and having a recess in which the first core is held; a board-shaped second core disposed in contact with the first core in an axial direction; and a cover disposed in the axial direction with respect to the housing and having a holding hole in which the second core is held, the cover closing an opening of the recess of the housing, the cover being made of a resin, wherein the first core has a first recess/projection portion formed on a first axial end surface at a side axially opposite to an axial end surface opposing a bottom wall of the recess, the second core has a second recess/projection portion formed on a second axial end surface that is in contact with the first axial end surface of the first core, the second recess/projection portion being fitted to the first recess/projection portion, and a gap is formed between opposing surfaces of the housing and the cover in a state where the first axial end surface and the second axial end surface are in contact with each other.

According to this configuration, the first axial end surface of the first core and the second axial end surface of the second core are in contact with each other, and the first recess/projection portion formed on the first axial end surface of the first core and the second recess/projection portion formed on the second axial end surface of the second core are fitted to each other. Thus, the first core and the second core are positioned in the axial direction, the radial direction, and the circumferential direction relative to each other. In addition, in a state where the first axial end surface of the first core and the second axial end surface of the second core are in contact with each other, a gap is formed between the opposing surfaces of the housing and the cover. Therefore, contact between the housing and the cover is avoided before the first core and the second core are brought into contact with each other, and thus the accuracy in positioning the first core and the second core relative to each other is enhanced. Furthermore, each of the housing and the cover is formed from a resin. Thus, the weight of the oil pump is reduced. Accordingly, while the weight of the oil pump is reduced, desired accuracy in assembling each component is ensured by the positioning of the first core and the second core in each direction relative to each other.

Another aspect of the present invention is directed to an oil pump including: an inner rotor having external teeth; an outer rotor having an inner rotor housing portion in which the inner rotor is rotatably housed in an eccentric state, and internal teeth that mesh with the external teeth; a tubular first core having a rotor housing portion in which the inner rotor and the outer rotor are housed, and a flange portion that projects radially outward from a tubular wall forming the rotor housing portion; a housing made of a resin and having a recess in which the first core is held and a flange-opposing portion that opposes the flange portion of the first core; and a board-shaped second core disposed in contact with the first core in an axial direction and closing an opening of the rotor housing portion, wherein the first core has a first contact portion that is in contact with the second core and a first engagement portion that is engaged with the second core in a state where the first contact portion is in contact with the second core, the second core has a second contact portion that is in contact with the first core and a second engagement portion that is engaged with the first core in a state where the second contact portion is in contact with the first core, and the oil pump has a gap formed between the flange portion of the first core and the flange-opposing portion of the housing in a state where the first contact portion and the second contact portion are in contact with each other.

According to this configuration, the first contact portion of the first core and the second contact portion of the second core are in contact with each other, and the first engagement portion of the first core and the second engagement portion of the second core are engaged with each other. Thus, the first core and the second core are positioned in the axial direction, the radial direction, and the circumferential direction relative to each other. In addition, in a state where the first contact portion of the first core and the second contact portion of the second core are in contact with each other, a gap is formed between the opposing surfaces of the housing and the first core. Therefore, contact between the housing and the first core is avoided in a state where the first core and the second core are in contact with each other, and thus the accuracy in positioning the first core and the second core relative to each other is enhanced. Furthermore, the housing is formed from a resin. Thus, the weight of the oil pump is reduced. Accordingly, while the weight of the oil pump is reduced, desired accuracy in assembling each component is ensured by the positioning of the first core and the second core in each direction relative to each other.

DESCRIPTION OF EMBODIMENTS

Specific embodiments of the oil pump according to the present invention will be described with reference to FIG. 1 to FIG. 28.

First Embodiment

Figure 1:
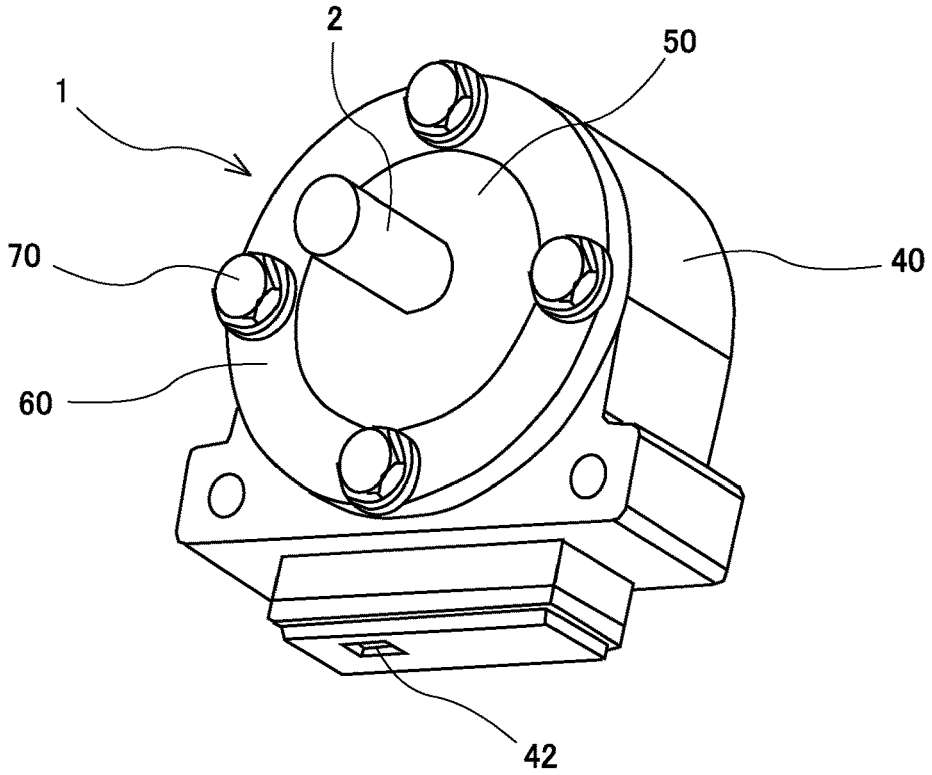
FIG. 1 is a perspective view of an oil pump according to a first embodiment as seen from the front side.
Figure 2:
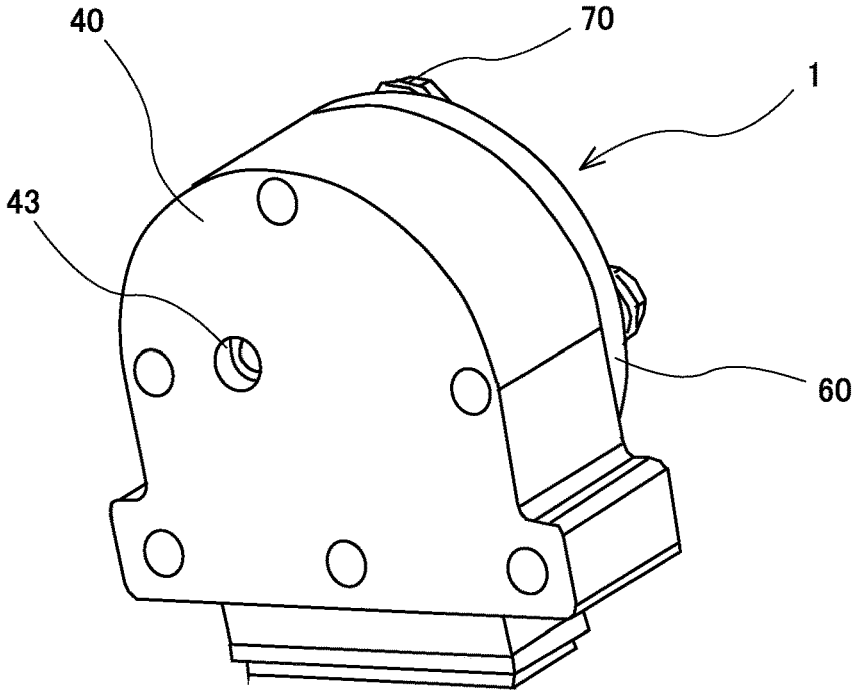
FIG. 2 is a perspective view of the oil pump as seen from the back side.

An oil pump 1 according to a first embodiment is a trochoid type gear pump that pressure-feeds sucked oil. The oil pump 1 is mounted, for example, on a vehicle or the like. The oil pump 1 is formed in a block shape as shown in FIG. 1 and FIG. 2.

Figure 3:
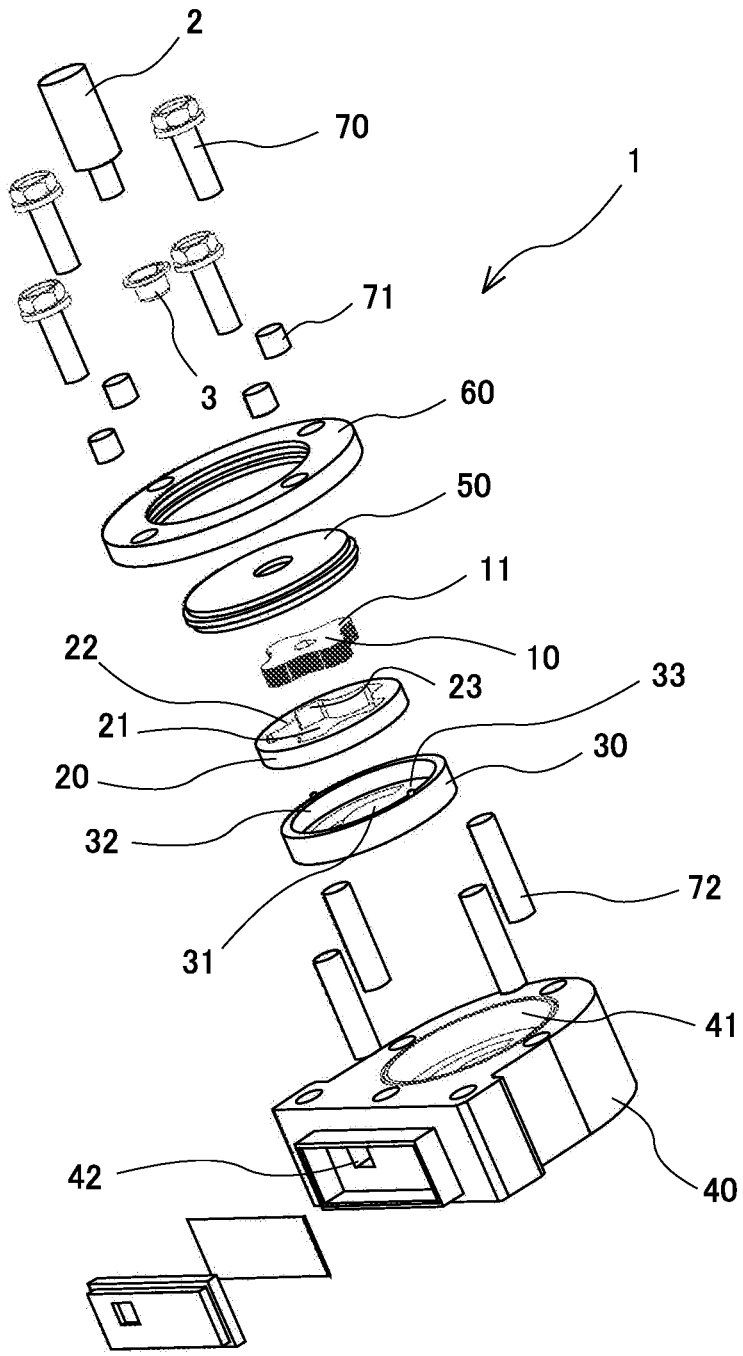
FIG. 3 is an exploded view of the oil pump.

As shown in FIG. 3, the oil pump 1 includes an inner rotor 10 and an outer rotor 20. The inner rotor 10 and the outer rotor 20 form a trochoid. Each of the inner rotor 10 and the outer rotor 20 is formed from a sintered metal (for example, an iron-based metal, a copper-iron-based metal, a copper-based metal, a stainless-based metal, etc.).

The inner rotor 10 is a disc-shaped or columnar member fixed to a drive shaft 2. The drive shaft 2 is mounted so as to be coaxial with the rotation center of the inner rotor 10. The drive shaft 2 is rotatably supported by a later-described second core via a bearing 3. The inner rotor 10 has external teeth 11. The external teeth 11 are provided on the outer circumferential surface of the inner rotor 10 at equiangular intervals. The number of the external teeth 11 of the inner rotor 10 is a predetermined number (for example, four).

The outer rotor 20 is an annular or cylindrical member with which the inner rotor 10 meshes. The outer rotor 20 has an inner rotor housing portion 21 and internal teeth 22. The inner rotor housing portion 21 is a space surrounded by a tubular wall 23. The inner rotor housing portion 21 has a volume that allows the inner rotor 10 to be rotatably housed therein in an eccentric state. The internal teeth 22 are provided so as to project from the inner circumferential surface of the tubular wall 23 toward the radially inner side. The internal teeth 22 are provided on the inner circumferential surface of the tubular wall 23 at equiangular intervals. The number of the internal teeth 22 of the outer rotor 20 is a predetermined number (for example, five) that is larger than the number of the external teeth 11 of the inner rotor 10 by a predetermined number (for example, one). The internal teeth 22 of the outer rotor 20 mesh with the external teeth 11 of the inner rotor 10. The inner rotor 10 is rotatably housed within the outer rotor 20 in a state where the inner rotor 10 is eccentric to the outer rotor 20 while the external teeth 11 mesh with the internal teeth 22 of the outer rotor 20.

The oil pump 1 includes a first core 30. The first core 30 is formed in a tubular shape (specifically, a cylindrical shape) so as to have a predetermined length in the axial direction. The first core 30 is formed from a metal such as iron or aluminum. The first core 30 is a molded article formed by pressing, heading, or die casting, or a workpiece subjected to cutting. The first core 30 may be formed from a thermosetting resin such as phenol resin instead of the metal, and may be a workpiece subjected to cutting.

Figure 6:
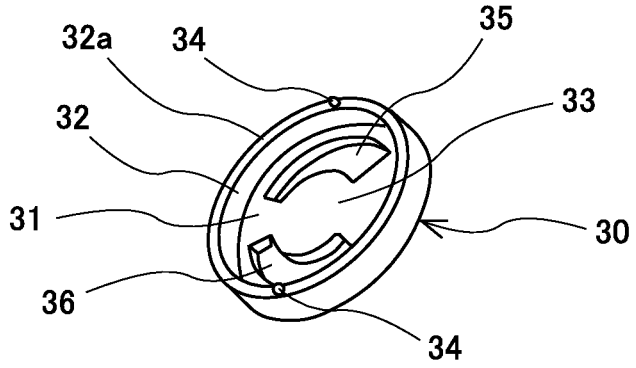
FIG. 6 is a perspective view of a first core of the oil pump.

As shown in FIG. 3 and FIG. 6, the first core 30 has a rotor housing portion 31. The rotor housing portion 31 is a space surrounded by a tubular wall 32 having a cylindrical shape and a bottom wall 33 having a disc shape. The rotor housing portion 31 has a volume that allows the inner rotor 10 and the outer rotor 20 to be housed therein. The inner rotor 10 and the outer rotor 20 are housed in the rotor housing portion 31. The rotor housing portion 31 is open at the side axially opposite to the bottom wall 33. The inner rotor 10 and the outer rotor 20 are inserted into the rotor housing portion 31 from the axial direction at the opening side of the rotor housing portion 31 when assembling the inner rotor 10 and the outer rotor 20 to the rotor housing portion 31. The outer rotor 20 is housed in the rotor housing portion 31.

The tubular wall 32 has a predetermined thickness in the radial direction. The tubular wall 32 has, at the side axially opposite to a portion thereof connected to the bottom wall 33, an axial end surface 32*a* that faces toward the axially outer side at the opening side. As shown in FIG. 6, a projection 34 is formed on the axial end surface 32*a* so as to project axially outward. The projection 34 is a positioning projection for positioning the first core 30 in the radial direction and the circumferential direction relative to a later-described second core. The projection 34 is formed in a pin shape. The projection 34 is preferably provided at a plurality of locations on the axial end surface 32*a* over the circumferential direction of the first core 30, in terms of positioning in the radial direction. FIG. 6 shows the first core 30 having the projection 34 provided at two locations.

Two communication grooves 35 and 36 are provided on the bottom wall 33. The communication groove 35 forms apart of an inflow passage that provides communication between an inflow hole of a later-described housing 40 and a volume chamber 37 (see FIG. 9) defined by a second core 50 within the rotor housing portion 31 of the first core 30. The communication groove 35 is formed such that the effective cross-sectional area of the passage increases from the end side in the anti-rotation direction of the drive shaft 2 and the inner rotor 10 to the end side in the rotation direction of the drive shaft 2 and the inner rotor 10 as seen from the axial direction. In addition, the communication groove 36 forms a part of a discharge passage that provides communication between the volume chamber 37 and a discharge hole of the housing 40. The communication groove 36 is formed such that the effective cross-sectional area of the passage decreases from the end side in the anti-rotation direction of the drive shaft 2 and the inner rotor 10 to the end side in the rotation direction of the drive shaft 2 and the inner rotor 10 as seen from the axial direction. The communication groove 35 and the communication groove 36 are not directly connected to each other at the bottom wall 33.

Figure 4:
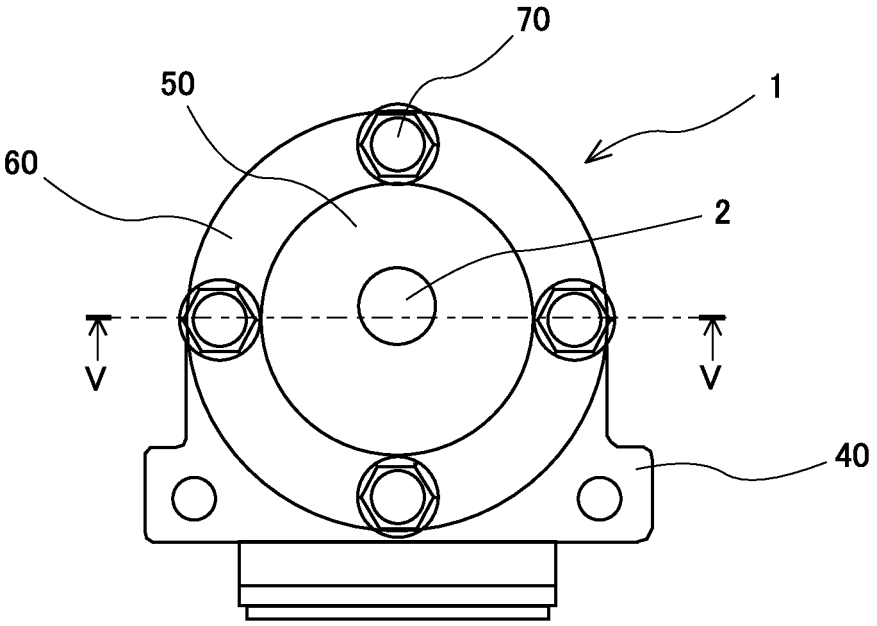
FIG. 4 is a front view of the oil pump.

As shown in FIG. 1, FIG. 2, and FIG. 4, the oil pump 1 includes the housing 40. The housing 40 is formed so as to have a size sufficient to hold the trochoid. The housing 40 is formed from a resin (particularly, a thermoplastic resin). The resin for forming the housing 40 preferably has excellent creep resistance, load resistance, wear resistance, etc., and is, for example, a polyphenylene sulfide (PPS) resin, a thermoplastic polyimide resin, or the like. The housing 40 is formed by injection molding or the like.

The housing 40 has a recess 41 in which the first core 30 is disposed and housed. The recess 41 is formed in a shape (specifically, a columnar shape) corresponding to the outer shape of the first core 30. The first core 30 is housed and held in the recess 41 such that the bottom wall 33 opposes the bottom wall of the recess 41 and the opening side of the first core 30 faces the opening side of the recess 41. As shown in FIG. 1 and FIG. 2, the housing 40 has: an inflow hole 42 into which oil flows; and a discharge hole 43 from which the oil is discharged. The inflow hole 42 communicates with the communication groove 35 of the first core 30 disposed in the recess 41. The discharge hole 43 communicates with the communication groove 36 of the first core 30 disposed in the recess 41. The oil that has flowed into the inflow hole 42 of the housing 40 is discharged from the discharge hole 43 to the outside via the communication grooves 35 and 36 of the first core 30.

The oil pump 1 includes the second core 50. The second core 50 is formed in a disc shape or a columnar shape so as to have a predetermined thickness in the axial direction. Similar to the first core 30, the second core 50 is formed from a metal such as iron or aluminum. The second core 50 may be a molded article formed by pressing, heading, or die casting, or a workpiece subjected to cutting. The second core 50 may be formed from a thermosetting resin such as phenol resin instead of the metal, and may be a workpiece subjected to cutting.

Figure 5:
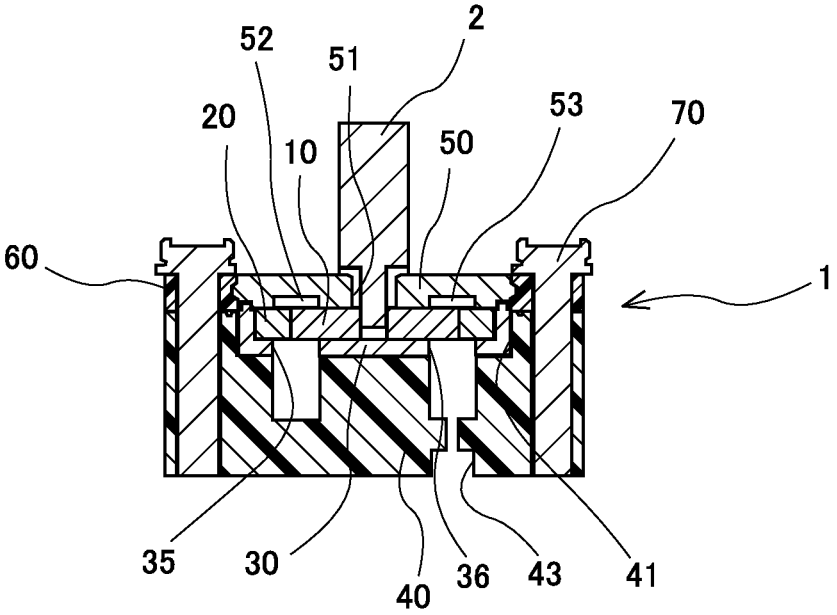
FIG. 5 is a cross-sectional view of the oil pump taken along a line V-V shown in FIG. 4.
Figure 10:
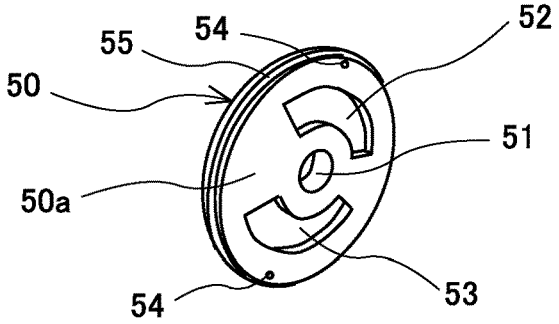
FIG. 10 is a perspective view of a second core of the oil pump.

The second core 50 is disposed so as to be adjacent to the first core 30 in the axial direction. The second core 50 is positioned in contact with the first core 30 in the axial direction. As shown in FIG. 5 and FIG. 10, a through hole 51 is provided in the second core 50 so as to penetrate the second core 50 in the axial direction. An end portion of the drive shaft 2 is inserted into the through hole 51. The drive shaft 2 is rotatably supported via the bearing 3 disposed in the through hole 51. In FIG. 5, the bearing 3 is not shown.

The second core 50 has two communication grooves 52 and 53 that communicate with the volume chamber 37 of the first core 30. The communication grooves 52 and 53 are formed on an axial end surface 50*a*, of the second core 50, which opposes the axial end surface 32*a* of the first core 30. The communication groove 52 is located at a position opposing the communication groove 35 of the first core 30 in the axial direction. In addition, the communication groove 53 is located at a position opposing the communication groove 36 of the first core 30 in the axial direction. Each of the communication grooves 52 and 53 is formed such that the effective cross-sectional area of the passage is substantially uniform from the end side in the anti-rotation direction of the drive shaft 2 and the inner rotor 10 to the end side in the rotation direction of the drive shaft 2 and the inner rotor 10. The communication groove 52 and the communication groove 53 are not directly connected to each other at the second core 50.

Holes 54 are formed on the axial end surface 50*a* of the second core 50 so as to be recessed in the axial direction. The holes 54 are positioning recesses for positioning the first core 30 in the radial direction and the circumferential direction relative to the second core 50. The holes 54 whose number is equal to the number of the projections 34 are provided in corresponding relation to the projections 34 of the first core 30. Each hole 54 is formed in a shape corresponding to the projection 34 and is, for example, a circular hole.

In order to avoid hindrance of contact between the axial end surface 32*a* of the first core 30 and the axial end surface 50*a* of the second core 50 due to fitting between the projections 34 and the holes 54, that is, in order to prevent occurrence of a situation in which the distal end of the projection 34 presses the bottom surface of the hole 54 when fitting the projection 34 thereinto, the depth in the axial direction of each hole 54 from the axial end surface 50*a* of the second core 50 is set so as to be not less than the length by which the projection 34 projects in the axial direction from the axial end surface 32*a* of the first core 30. Similar to the projections 34, the holes 54 are preferably provided at a plurality of locations on the axial end surface 50*a* over the circumferential direction of the second core 50.

The first core 30 and the second core 50 are positioned in the axial direction relative to each other by bringing the axial end surface 32*a* of the first core 30 and the axial end surface 50*a* of the second core 50 into contact with each other, and are also positioned in the radial direction and the circumferential direction relative to each other by fitting the projections 34 into the holes 54.

The oil pump 1 includes a cover 60. The cover 60 is disposed in the axial direction at the opening side of the recess 41 with respect to the housing 40. The cover 60 closes the opening of the recess 41 of the housing 40. The cover 60 is a member formed in a disc shape or an annular shape. The cover 60 is formed from a resin (particularly, a thermoplastic resin). The resin for forming the cover 60 preferably has excellent creep resistance, load resistance, wear resistance, etc., and is, for example, a polyphenylene sulfide (PPS) resin, a thermoplastic polyimide resin, or the like. The material of the cover 60 may be the same as the material of the housing 40. The cover 60 is formed by injection molding or the like.

Figure 13:
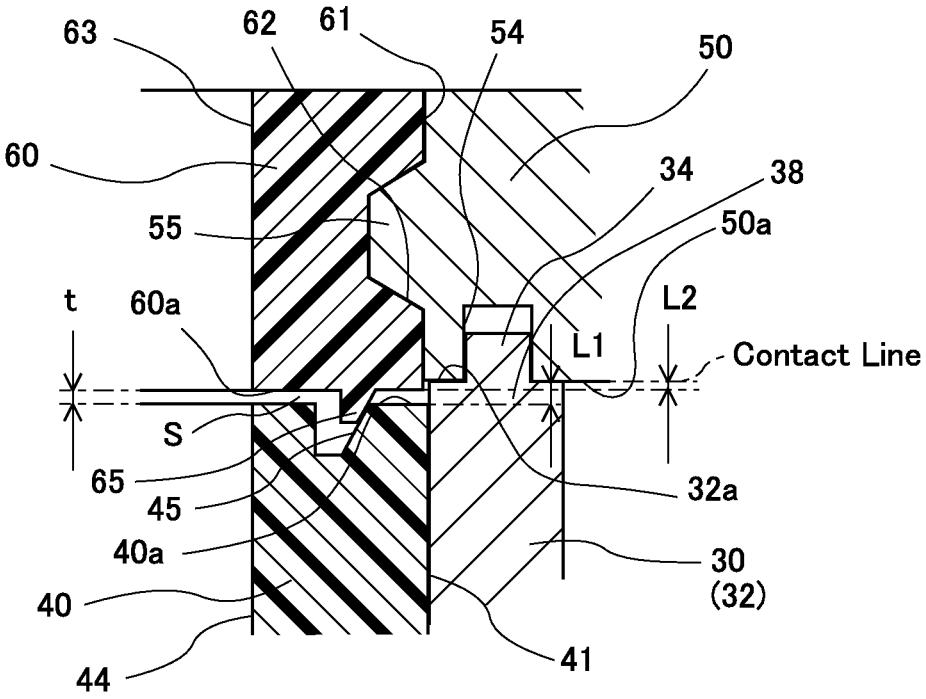
FIG. 13 is an enlarged cross-sectional view of a main part of the oil pump.

As shown in FIG. 13, the cover 60 has a holding hole 61 for holding the second core 50 and a holding groove 62 for fitting the second core 50 therein. The holding hole 61 penetrates the cover 60 in the axial direction at the axial center of the cover 60. The holding hole 61 is formed so as to have a size corresponding to the outer shape of the second core 50. The holding groove 62 is provided on the periphery of the holding hole 61 and formed in an annular shape. A projection 55 is formed in an annular shape on the outer peripheral side surface of the second core 50 so as to project radially outward. The second core 50 is held in the holding hole 61 of the cover 60 by fitting the projection 55 into the holding groove 62 of the cover 60.

Figure 11:
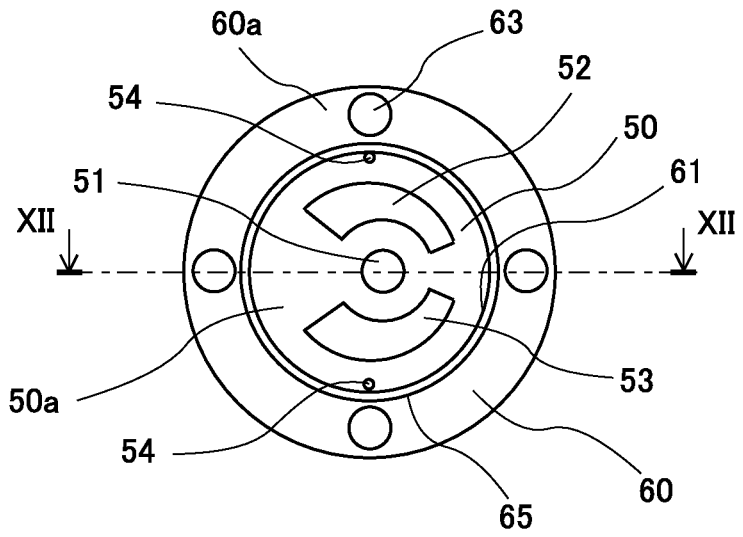
FIG. 11 is a front view of an assembly obtained by assembling the second core to a cover of the oil pump.
Figure 12:
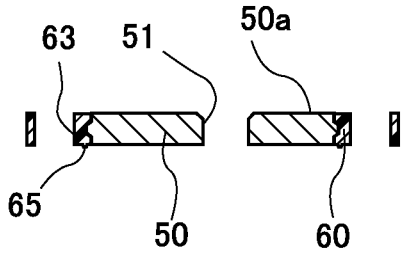
FIG. 12 is a cross-sectional view of the assembly obtained by assembling the second core to the cover, taken along a line XII-XII shown in FIG. 11.

As shown in FIG. 11 and FIG. 12, the cover 60 has, in a portion thereof located radially outward of the holding hole 61, a fastening hole 63 that penetrates the cover 60 in the axial direction and that has a circular cross-section. The fastening hole 63 is provided at a plurality of locations (four locations in FIG. 11) over the circumferential direction. In addition, the housing 40 has, in a portion thereof located radially outward of the recess 41, a fastening hole 44 that extends in the axial direction and that has a circular cross-section. The fastening hole 44 is provided at a plurality of locations (four locations in FIG. 7) in the circumferential direction around the drive shaft 2. The fastening holes 63 and the fastening holes 44, the numbers of which are equal to each other, are provided at positions corresponding to each other. The cover 60 is fastened and fixed to the housing 40 by inserting bolts 70 into collars 71 disposed within the fastening holes 63 of the cover 60 and collars 72 disposed within the fastening holes 44 of the housing 40 and screwing the bolts 70 into nuts (not shown). In FIG. 5, the collars 71 and 72 are not shown.

When the cover 60 is fixed to the housing 40, the axial end surface 32*a* of the first core 30 held in the recess 41 of the housing 40 and the axial end surface 50*a* of the second core 50 held in the holding hole 61 of the cover 60 are brought into contact with each other, and an axial end surface 40*a*, of the housing 40, which is located radially outward of the recess 41, and an axial end surface 60*a*, of the cover 60, which is located radially outward of the holding hole 61, oppose each other in the axial direction. Hereinafter, these axial end surfaces 40*a* and 60*a* are referred to as opposing surfaces 40*a* and 60*a*, respectively. When the opposing surface 40*a* of the housing 40 and the opposing surface 60*a* of the cover 60 oppose each other as described above, the opposing surfaces 40*a* and 60*a* are not in contact with each other, except for a later-described seal structure portion, as shown in FIG. 13. That is, a gap S is formed between the opposing surfaces 40*a* and 60*a*. The gap S has a length t in the axial direction.

The first core 30 is formed such that, in a state where the first core 30 is held in the recess 41 of the housing 40, an axial end portion 38 including the axial end surface 32*a* of the tubular wall 32 protrudes axially outward of the opposing surface 40*a* of the housing 40. In a state where the first core 30 is held in the recess 41 of the housing 40, the position in the axial direction of the axial end surface 32*a* of the first core 30 is at the outer side (cover 60 side) in the axial direction with respect to the opposing surface 40*a* of the housing 40. In addition, the second core 50 is formed such that, in a state where the second core 50 is held in the holding hole 61 of the cover 60, the axial end surface 50*a* does not protrude axially outward of the opposing surface 60*a* of the cover 60 and is located within the holding hole 61. In a state where the second core 50 is held in the holding hole 61 of the cover 60, the position in the axial direction of the axial end surface 50*a* of the second core 50 is not at the outer side in the axial direction with respect to the opposing surface 60*a* of the cover 60 but is within the holding hole 61 at the inner side in the axial direction with respect to the opposing surface 60*a* of the cover 60.

In a state where the cover 60 is attached and fixed to the housing 40 and the axial end surface 32*a* of the first core 30 and the axial end surface 50*a* of the second core 50 are in contact with each other, a relationship of the following formula (1) is satisfied where: the length by which the axial end portion 38 including the axial end surface 32*a* of the first core 30 protrudes axially outward of the opposing surface 40*a* of the housing 40 (that is, the distance by which the axial end surface 32*a* of the first core 30 and the opposing surface 40*a* of the housing 40 are displaced relative to each other in the axial direction (the distance in the axial direction therebetween)) is denoted by L1; and the distance by which the axial end surface 50*a* of the second core 50 is recessed axially inward from the opposing surface 60*a* of the cover 60 (that is, the distance by which the axial end surface 50*a* of the second core 50 and the opposing surface 60*a* of the cover 60 are displaced relative to each other in the axial direction (the distance in the axial direction therebetween)) is denoted by L2 (note that L2 only needs to be 0 or greater). In addition, the length t of the gap S and the distances L1 and L2 satisfy a relationship of the following formula (1)'.

$$L1>L2 \quad (1)$$

$$L1-L2=t \quad (1)'$$

Figure 7:
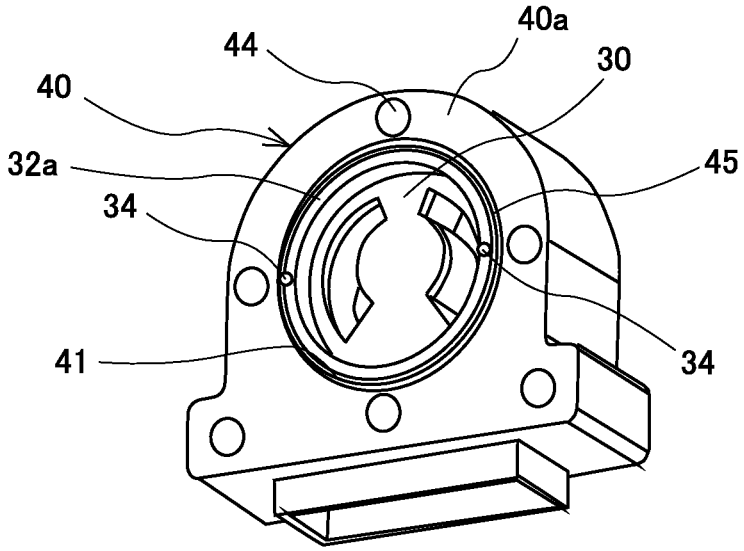
FIG. 7 is a perspective view of an assembly obtained by assembling the first core to a housing of the oil pump.
Figure 8:
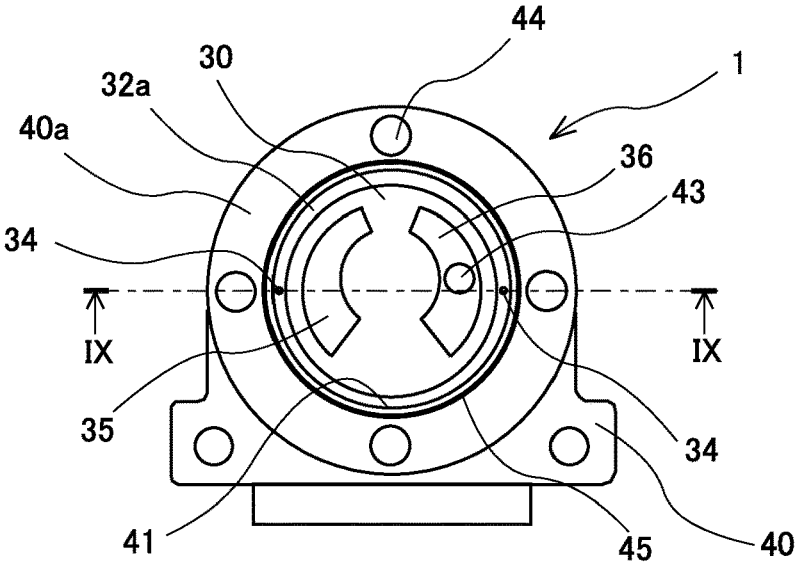
FIG. 8 is a front view of the assembly obtained by assembling the first core to the housing of the oil pump.
Figure 9:
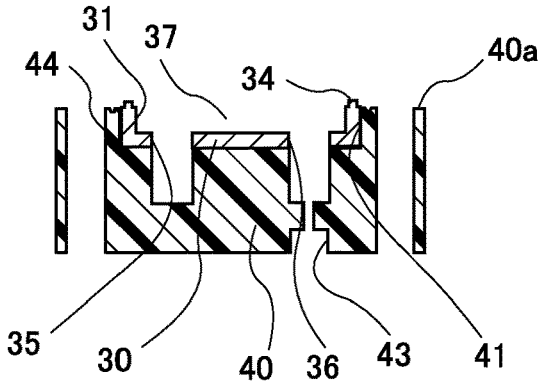
FIG. 9 is a cross-sectional view of the assembly obtained by assembling the first core to the housing, taken along a line IX-IX shown in FIG. 8.

The opposing surfaces 40*a* and 60*a* of the housing 40 and the cover 60 have a seal structure. The seal structure is a structure in which a recess and a projection are fitted to each other. As shown in FIG. 7 and FIG. 8, a recess-like portion 45 is provided on the opposing surface 40*a* of the housing 40. The recess-like portion 45 is an annular groove formed in an annular shape on the opposing surface 40*a*. A projection-like portion 65 is provided on the opposing surface 60*a* of the cover 60. The projection-like portion 65 is an annular projection formed in an annular shape on the opposing surface 60*a*. The recess-like portion 45 and the projection-like portion 65 are formed in shapes corresponding to each other (for example, in trapezoidal shapes). When assembling the housing 40 and the cover 60 to each other, the recess-like portion 45 and the projection-like portion 65, while coming into contact with each other, elastically deform to come into close contact with each other. At this time, the recess-like portion 45 and the projection-like portion 65 come into close contact and become fitted to each other over the entire circumference in the circumferential direction without any gap therebetween. When the projection-like portion 65 is fitted into the recess-like portion 45 as described above, sealing is ensured.

In the above oil pump 1, when the drive shaft 2 rotates, the inner rotor 10, which forms the trochoid within the rotor housing portion 31 of the first core 30, rotates relative to the outer rotor 20. During the rotation, when the internal pressure of the volume chamber 37 within the rotor housing portion 31 of the first core 30 becomes negative due to an increase in volume of the volume chamber 37, the oil is sucked from the inflow hole 42 into the volume chamber 37. Thereafter, when the internal pressure of the volume chamber 37 rises due to a decrease in volume of the volume chamber 37 caused by the rotation of the trochoid, the oil sucked into the volume chamber 37 is introduced to the discharge hole 43 and discharged to the outside. When this pumping action is continuously performed by the rotation of the trochoid, the oil is pressure-fed from the oil pump 1.

In the oil pump 1 having the above structure, when the inner rotor 10 and the outer rotor 20 are housed in the rotor housing portion 31 of the first core 30 and the cover 60 having the second core 50 held in the holding hole 61 is fixed to the housing 40, which has the first core 30 disposed in the recess 41, by fastening the bolts 70, the axial end surface 32*a* of the first core 30 and the axial end surface 50*a* of the second core 50 are brought into contact with each other.

Each of the first core 30 and the second core 50 is formed from a metal. Therefore, in a state where the above contact has occurred, the first core 30 and the second core 50 do not move in the axial direction relative to each other, and thus both cores 30 and 50 are positioned in the axial direction relative to each other. In addition, in a state where the above contact has occurred, the projections 34 provided on the axial end surface 32*a* of the first core 30 are fitted into the holes 54 provided on the axial end surface 50*a* of the second core 50, and thus both cores 30 and 50 are positioned in the radial direction and the circumferential direction relative to each other. Moreover, each of the first core 30 and the second core 50 is a cut workpiece subjected to cutting. Therefore, both cores 30 and 50 are more accurately positioned in the axial direction, positioned in the radial direction, and positioned in the circumferential direction.

In a state where the axial end surface 32*a* of the first core 30 and the axial end surface 50*a* of the second core 50 are in contact with each other, the gap S having the length t is formed between the opposing surface 40*a* of the housing 40 and the opposing surface 60*a* of the cover 60. Therefore, contact between the housing 40 and the cover 60 is avoided before the first core 30 and the second core 50 are brought into contact with each other, and thus the accuracy in positioning the first core 30 and the second core 50 relative to each other is enhanced.

When the first core 30 and the second core 50 are positioned in the axial direction, the radial direction, and the circumferential direction relative to each other as described above, variations in volume of the volume chamber 37 within the first core 30, in which the inner rotor 10 and the outer rotor 20 are housed, are reduced, and thus a stable discharge amount is ensured. In addition, when the first core 30 and the second core 50 are positioned in the axial direction, the radial direction, and the circumferential direction relative to each other as described above, the accuracy in assembling each component when assembling the oil pump 1 is significantly improved.

Each of the housing 40 and the cover 60 is formed from a resin. Therefore, the weight of the oil pump 1 is reduced as compared to that with a structure in which each of the housing 40 and the cover 60 is formed from a metal. In addition, in a state where the axial end surface 32*a* of the first core 30 and the axial end surface 50*a* of the second core 50 are in contact with each other, the housing 40 and the cover 60 do not come into contact with each other, and thus the housing 40 and the cover 60 do not need to be precisely processed. Therefore, time and effort in manufacturing are saved, and the manufacturing time is shortened.

Accordingly, in the oil pump 1, while the weight of the entire oil pump 1 is reduced by forming each of the housing 40 and the cover 60 from a resin, desired accuracy in assembling each component is ensured by the positioning of the first core 30 and the second core 50 in each direction relative to each other.

In the oil pump 1, in a state where the first core 30 and the second core 50 are positioned relative to each other, the opposing surface 40*a* of the housing 40 and the opposing surface 60*a* of the cover 60 are not in contact with each other at the outer side in the radial direction with respect to these cores 30 and 50. However, the opposing surfaces 40*a* and 60*a* have the seal structure. Specifically, the projection-like portion 65 provided on the opposing surface 60*a* of the cover 60 is fitted into the recess-like portion 45 provided on the opposing surface 40*a* of the housing 40. This fitting is achieved such that the recess-like portion 45 and the projection-like portion 65 are in close contact with each other, without any gap therebetween, over the entire circumference in the circumferential direction.

Therefore, in the oil pump 1, even though the gap S is formed between the opposing surface 40*a* of the housing 40 and the opposing surface 60*a* of the cover 60, leaking of the oil through the gap S from the recess 41 side of the housing 40 in which the first core 30, wherein the trochoid formed by the inner rotor 10 and the outer rotor 20 is housed, is disposed, is inhibited by the above seal structure.

In the above first embodiment, the axial end surface 32*a* of the first core 30 corresponds to "first axial end surface" described in the claims, the axial end surface 50*a* of the second core 50 corresponds to "second axial end surface" described in the claims, the projections 34 of the first core 30 correspond to "first recess/projection portion" described in the claims, the holes 54 of the second core 50 correspond to "second recess/projection portion" described in the claims, the opposing surface 40*a* of the housing 40 corresponds to "first opposing surface" described in the claims, and the opposing surface 60*a* of the cover 60 corresponds to "second opposing surface" described in the claims.

Meanwhile, in the above first embodiment, the projections 34 are formed on the axial end surface 32*a* of the tubular wall 32 of the first core 30 so as to project axially outward, and the holes 54 are formed on the axial end surface 50*a* of the second core 50 so as to be recessed in the axial direction. However, the present invention is not limited thereto. Holes may be formed on the axial end surface 32*a* of the tubular wall 32 of the first core 30 so as to be recessed in the axial direction, and projections may be formed on the axial end surface 50*a* of the second core 50 so as to project axially outward. In this case, in order to avoid hindrance of contact between the axial end surface 32*a* of the first core 30 and the axial end surface 50*a* of the second core 50 due to fitting between the projections and the holes, that is, in order to prevent occurrence of a situation in which the distal end of projection presses the bottom surface of the hole when fitting the projection thereinto, the depth in the axial direction of each hole from the axial end surface 32*a* of the first core 30 is set so as to be not less than the length by which the projection projects in the axial direction from the axial end surface 50*a* of the second core 50. In this modification as well, the same advantageous effects as those in the above first embodiment are obtained.

Second Embodiment

In the above first embodiment, in order to form the gap S between the opposing surface 40*a* of the housing 40 and the opposing surface 60*a* of the cover 60, the axial end surface 32*a* of the tubular wall 32 of the first core 30 is located so as to protrude axially outward of the opposing surface 40*a* of the housing 40, and the axial end surface 50*a* of the second core 50 is located so as to be recessed axially inward from the opposing surface 60*a* of the cover 60; and, in addition, the relationship of the above formula (1) is satisfied. That is, the distance L1 in the axial direction, which is the distance by which the axial end surface 32*a* of the first core 30 protrudes axially outward of the opposing surface 40*a* of the housing 40, is made larger than the distance L2 in the axial direction, which is the distance by which the axial end surface 50*a* of the second core 50 is recessed axially inward from the opposing surface 60*a* of the cover 60.

On the other hand, in the second embodiment, in order to form the gap S between the opposing surface 40*a* of the housing 40 and the opposing surface 60*a* of the cover 60, the axial end surface 32*a* of the tubular wall 32 of a first core 110 may be located so as to be recessed axially inward from the opposing surface 40*a* of the housing 40, and an axial end surface 120*a* of a second core 120 may be located so as to protrude axially outward of the opposing surface 60*a* of the cover 60; and, in addition, the distance in the axial direction by which the axial end surface 32*a* of the first core 110 and the opposing surface 40*a* of the housing 40 are displaced relative to each other in the axial direction (note that this distance in the axial direction only needs to be not less than 0) may be made smaller than the distance in the axial direction by which the axial end surface 120*a* of the second core 120 and the opposing surface 60*a* of the cover 60 are displaced relative to each other in the axial direction. In this modification as well, the same advantageous effects as those in the above embodiment are obtained.

Specifically, similar to the oil pump 1 according to the first embodiment, an oil pump 100 according to the second embodiment is a trochoid type gear pump that pressure-feeds sucked oil. In the oil pump 100, the same components as those in the oil pump 1 are designated by the same reference numerals, and the description thereof is omitted or simplified. The oil pump 100 includes the first core 110 and the second core 120 instead of the first core 30 and the second core 50 of the oil pump 1. The first core 110 has the same configuration as the first core 30 except for a later-described portion. The second core 120 has the same configuration as the second core 50 except for a later-described portion.

Figure 14:
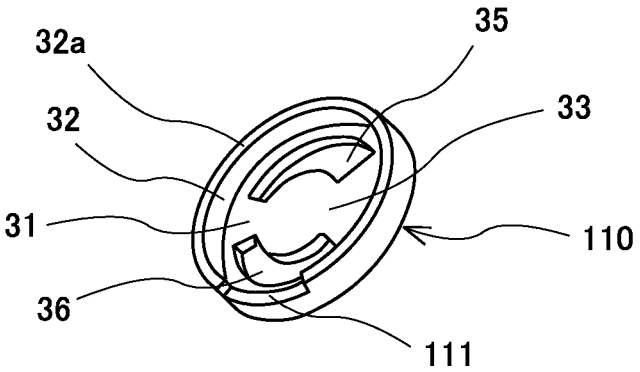
FIG. 14 is a perspective view of a first core of an oil pump according to a second embodiment.
Figure 15:
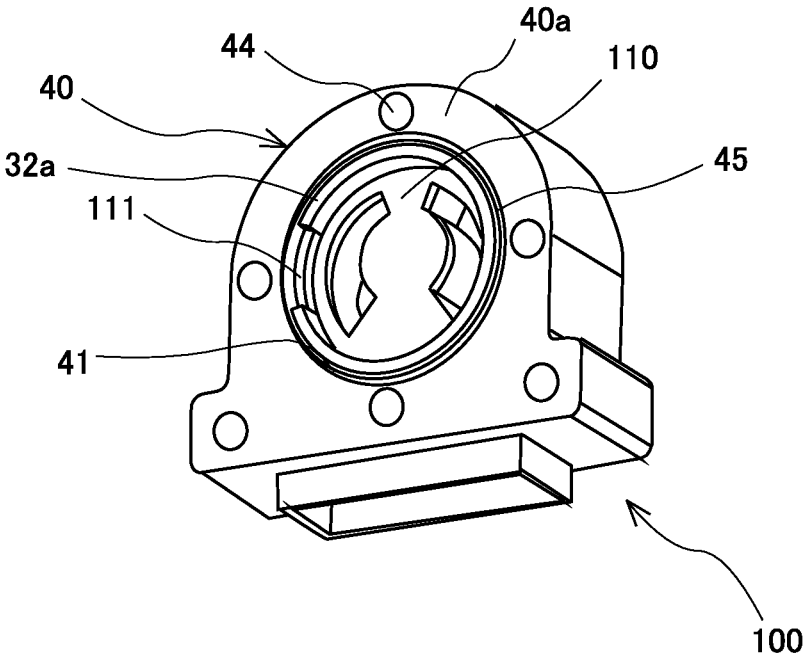
FIG. 15 is a perspective view of an assembly obtained by assembling the first core to a housing of the oil pump.

As shown in FIG. 14, the first core 110 has a rotor housing portion 31 surrounded by a tubular wall 32 and a bottom wall 33. A cut portion 111 is formed on the axial end surface 32*a* of the tubular wall 32 by cutting a part in the circumferential direction of the tubular wall 32. The cut portion 111 is a positioning recess for positioning the first core 110 in the radial direction and the circumferential direction relative to the second core 120. The cut portion 111 is provided at one location in the circumferential direction on the tubular wall 32 of the first core 110 and extends in a curved shape in the circumferential direction. The first core 110 is disposed and held in the recess 41 of the housing 40 as shown in FIG. 15.

Figure 16:
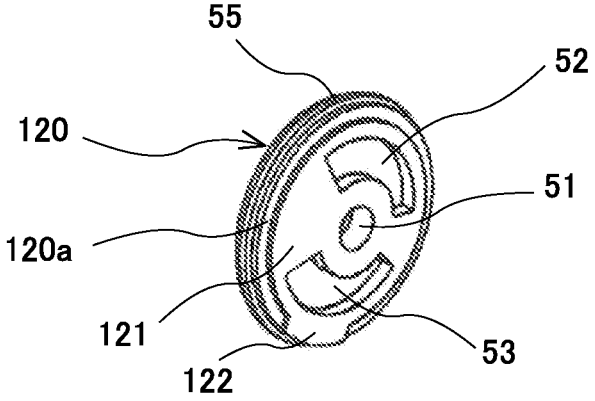
FIG. 16 is a perspective view of a second core of the oil pump.

As shown in FIG. 16, the second core 120 is disposed so as to be adjacent to the first core 110 in the axial direction. The second core 120 is positioned in contact with the first core 110 in the axial direction. A projection disc portion 121 is formed on the axial end surface 120*a* of the second core 120 in a region including an axial center portion of the axial end surface 120*a* so as to project in the axial direction. The projection disc portion 121 is formed in a substantially disc shape. The projection disc portion 121 is formed so as to be fitted to the radially inner side of the tubular wall 32 of the first core 110. The outer diameter of the projection disc portion 121 is equal to the inner diameter of the tubular wall 32 of the first core 110.

Figure 17:
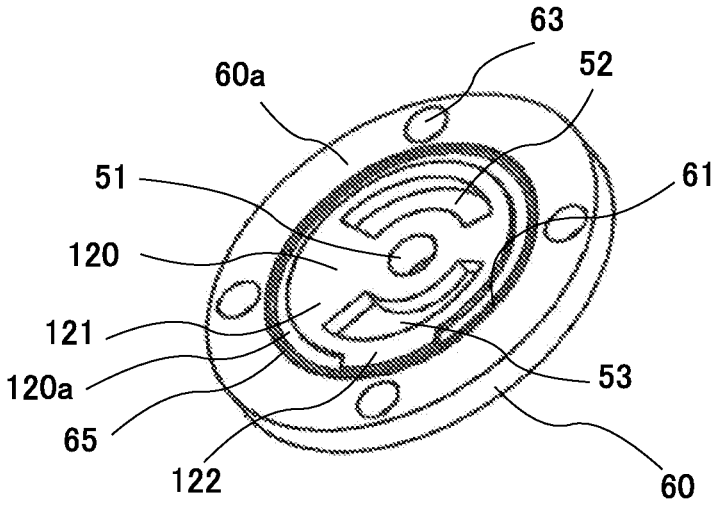
FIG. 17 is a perspective view of an assembly obtained by assembling the second core to a cover of the oil pump.

As shown in FIG. 17, a recessed groove is formed at the outer peripheral side of the projection disc portion 121 of the second core 120 so as to extend along the outer edge thereof. The recessed groove is formed in a C-shape as seen from the axial direction. The bottom surface of the recessed groove forms a portion, of the axial end surface 120*a*, which comes into contact with the axial end surface 32*a* of the first core 110. A projection 122 is continuously and integrally formed on the projection disc portion 121 so as to project in the axial direction from a part in the circumferential direction of the outer edge of the axial end surface 120*a* of the second core 120. The projection 122 and the projection disc portion 121 are formed so as to have surfaces that are flush with each other. The projection 122 is provided at one location in the circumferential direction on the outer edge of the second core 120 and extends in a curved shape in the circumferential direction. The projection 122 is a positioning projection for positioning the first core 110 in the radial direction and the circumferential direction relative to the second core 120. The projection 122 is formed in a shape corresponding to the cut portion 111. The second core 120 is held in the holding hole 61 of the cover 60 as shown in FIG. 17.

In order to avoid hindrance of contact between the axial end surface 32*a* of the first core 110 and the axial end surface 120*a* of the second core 120 due to fitting between the projection 122 and the cut portion 111, that is, in order to prevent occurrence of a situation in which the distal end of the projection 122 presses the bottom surface of the cut portion 111 when fitting the projection 122 thereinto, the depth in the axial direction of the cut portion 111 from the axial end surface 32*a* of the first core 110 is set so as to be not less than the length by which the projection 122 projects in the axial direction from the axial end surface 120*a* of the second core 120.

Figure 18:
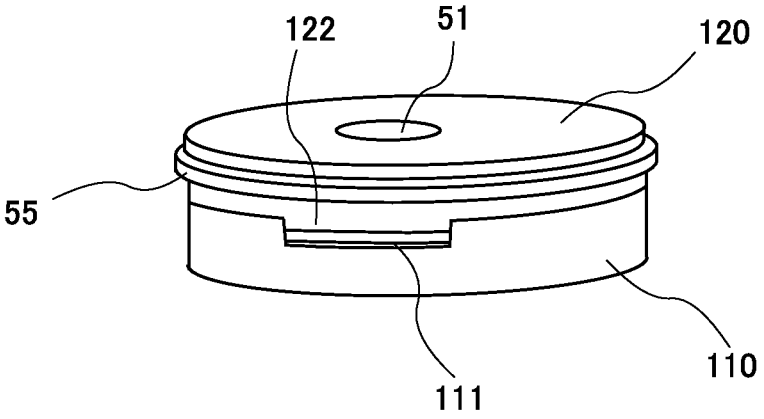
FIG. 18 is a perspective view representing a state where the first core and the second core of the oil pump are disposed in contact with each other.
Figure 19:
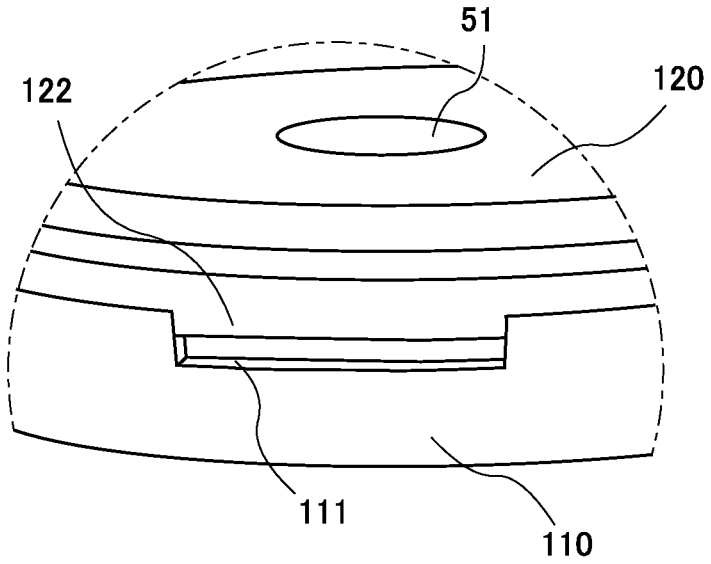
FIG. 19 is an enlarged view of a main part in a state where the first core and the second core of the oil pump are disposed in contact with each other.

The first core 110 and the second core 120 are positioned in the axial direction relative to each other by bringing the axial end surface 32*a* of the first core 110 and the axial end surface 120*a* of the second core 120 into contact with each other, and are positioned in the radial direction and the circumferential direction relative to each other by fitting the projection 122 into the cut portion 111 (see FIG. 18 and FIG. 19).

Figure 20:
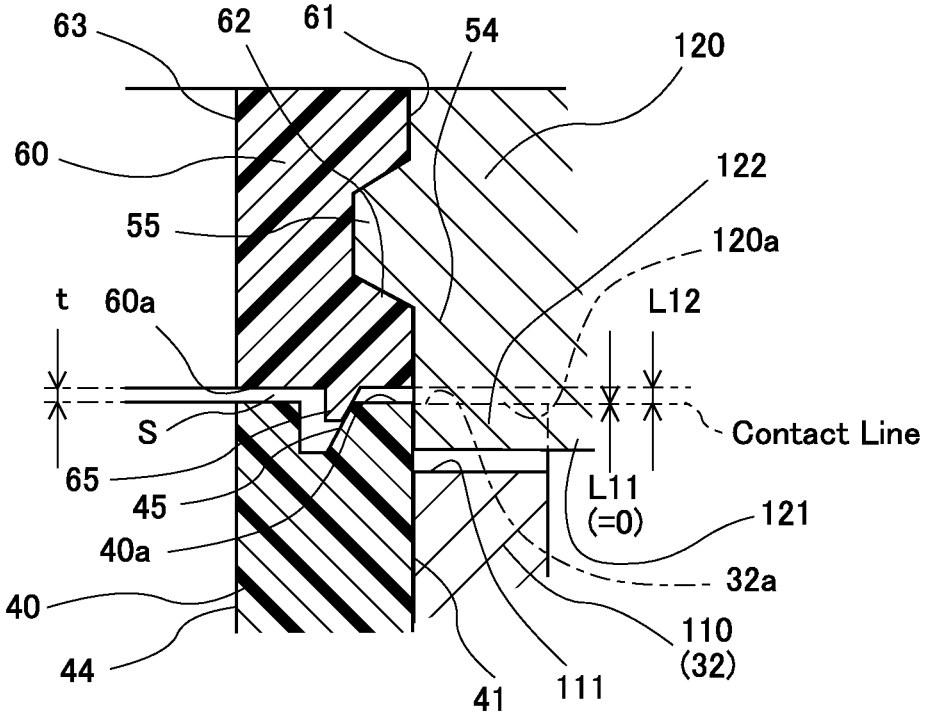
FIG. 20 is an enlarged cross-sectional view of a main part of the oil pump.
Figure 21:
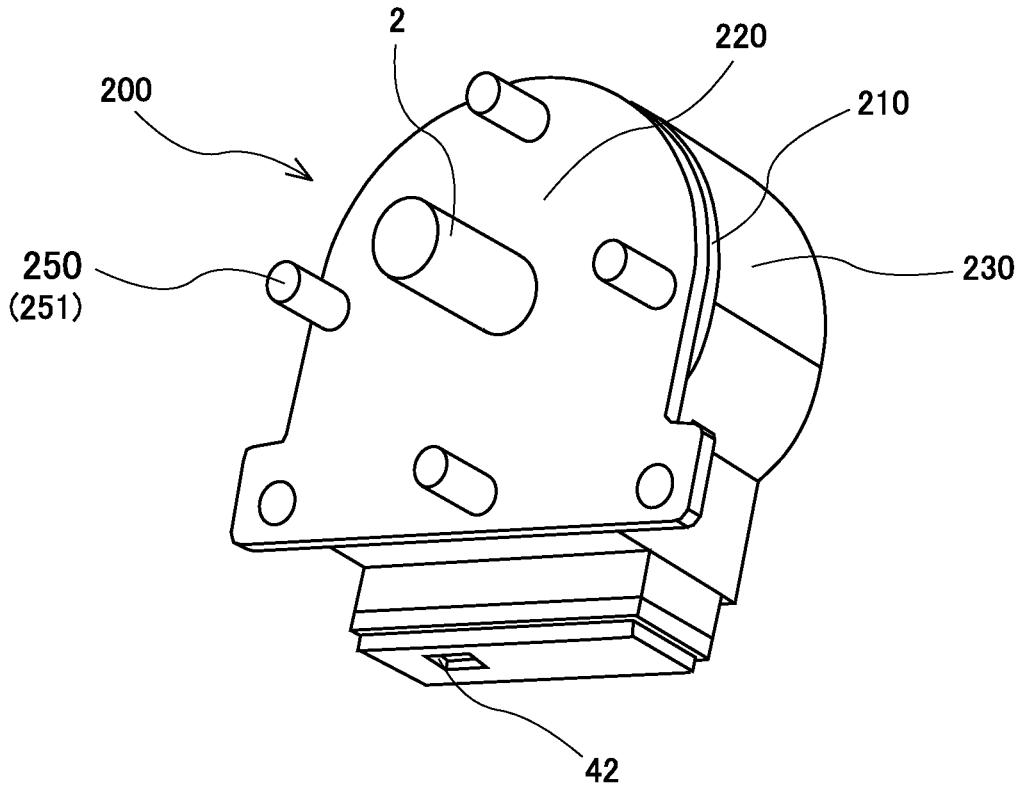
FIG. 21 is a perspective view of an oil pump according to a third embodiment as seen from the front side.
Figure 22:
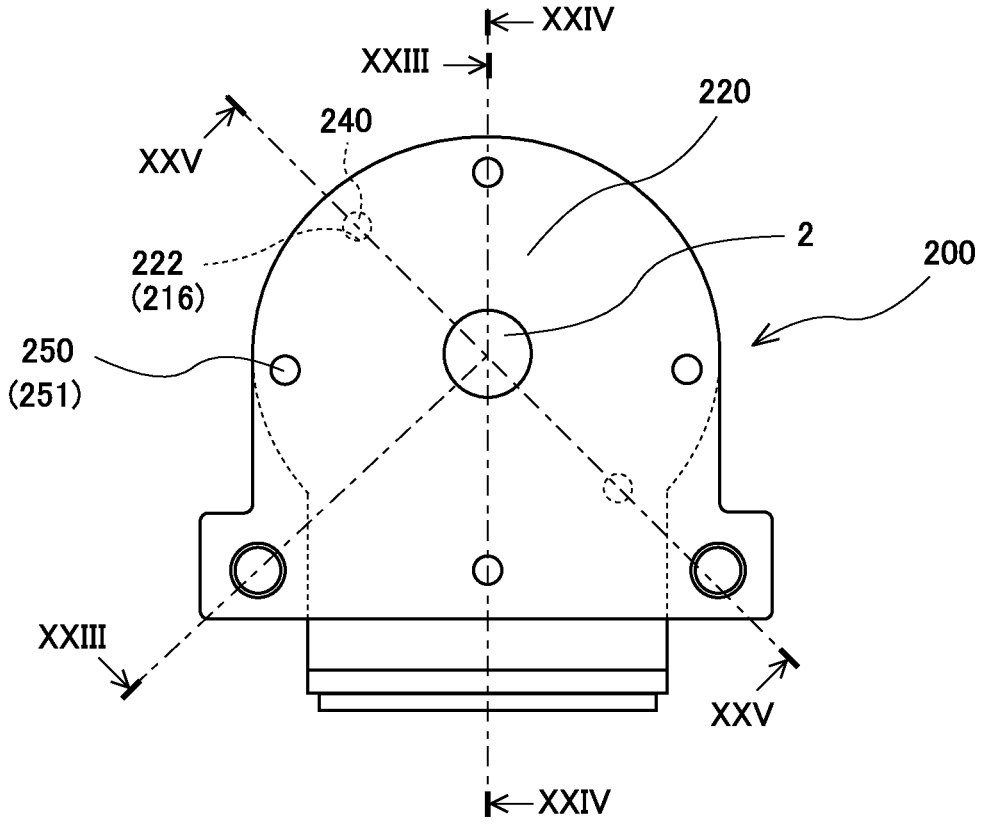
FIG. 22 is a front view of the oil pump.
Figure 23:
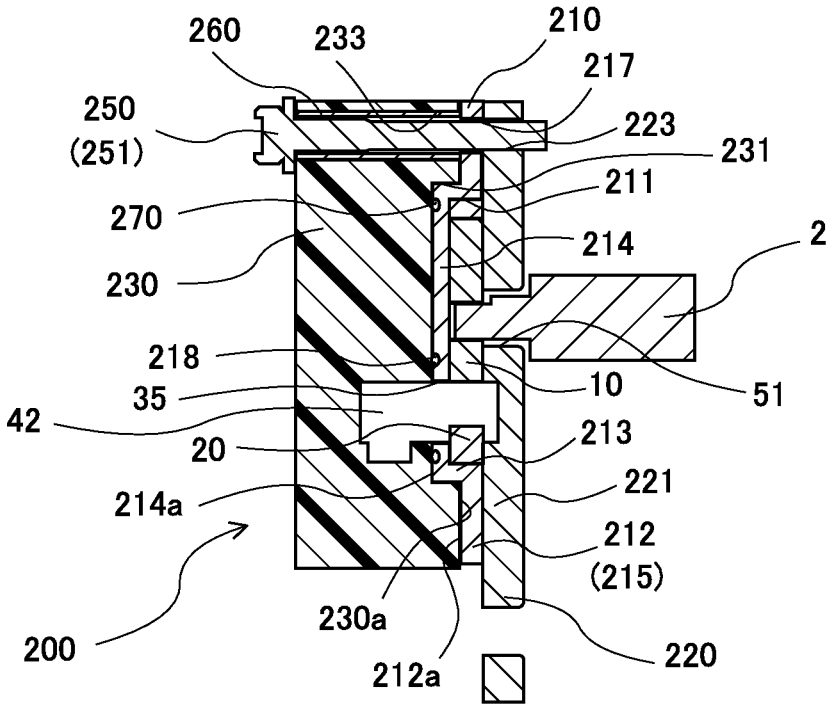
FIG. 23 is a cross-sectional view of the oil pump taken along a line XXIII-XXIII shown in FIG. 22.
Figure 24:
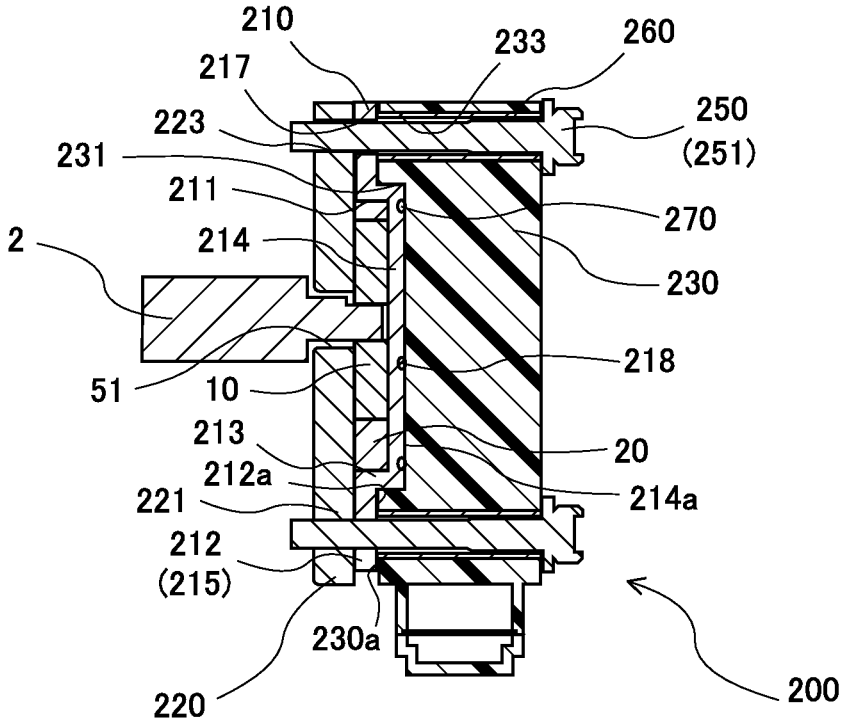
FIG. 24 is a cross-sectional view of the oil pump taken along a line XXIV-XXIV shown in FIG. 22.
Figure 25:
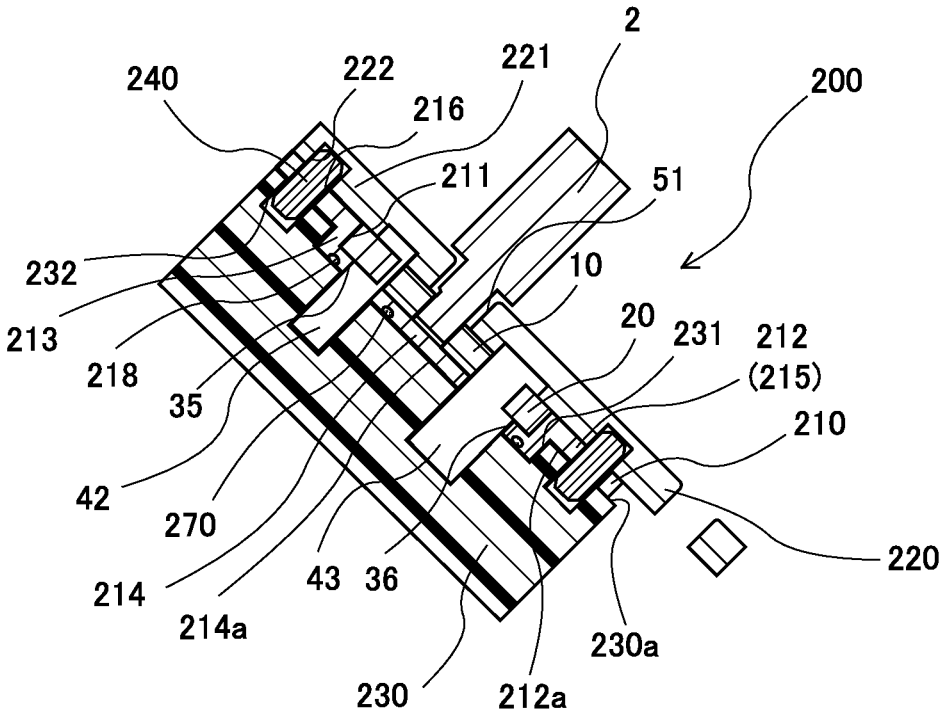
FIG. 25 is a cross-sectional view of the oil pump taken along a line XXV-XXV shown in FIG. 22.

When the cover 60 having the second core 120 held in the holding hole 61 is fixed to the housing 40 having the first core 110 held in the recess 41, the axial end surface 32*a* of the first core 110 and the axial end surface 120*a* of the second core 120 are brought into contact with each other, and the opposing surface 40*a*, of the housing 40, which is located radially outward of the recess 41, and the opposing surface 60*a*, of the cover 60, which is located radially outward of the holding hole 61, oppose each other in the axial direction. When the opposing surface 40*a* of the housing 40 and the opposing surface 60*a* of the cover 60 oppose each other, the opposing surfaces 40*a* and 60*a* are not in contact with each other, except for a later-described seal structure portion, as shown in FIG. 20. That is, a gap S is formed between the opposing surfaces 40*a* and 60*a*. The gap S has a length t in the axial direction.

The first core 110 is formed such that, in a state where the first core 110 is held in the recess 41 of the housing 40, the position in the axial direction of the axial end surface 32*a* of the tubular wall 32 is not at the outer side in the axial direction with respect to the opposing surface 40*a* of the housing 40, that is, is a position recessed within the recess 41. In addition, the second core 120 is formed such that, in a state where the second core 120 is held in the holding hole 61 of the cover 60, the position in the axial direction of the axial end surface 120*a* is at the outer side (housing 40 side) in the axial direction with respect to the opposing surface 60*a* of the cover 60, that is, a position protruding axially outward of the opposing surface 60*a* of the cover 60.

In a state where the cover 60 is attached and fixed to the housing 40 and the axial end surface 32*a* of the first core 110 and the axial end surface 120*a* of the second core 120 are in contact with each other, a relationship of the following formula (2) is satisfied, where: the distance by which the position in the axial direction of the axial end surface 32*a* of the first core 110 is recessed axially inward from the opposing surface 40*a* of the housing 40 (that is, the distance by which the axial end surface 32*a* of the first core 110 and the opposing surface 40*a* of the housing 40 are displaced relative to each other in the axial direction (the distance in the axial direction therebetween)) is denoted by L11 (Note that L11 only needs to be not less than 0. FIG. 20 shows the case of L11=0.); and the distance by which the axial end surface 120*a* of the second core 120 protrudes axially outward of the opposing surface 60*a* of the cover 60 (that is, the distance by which the axial end surface 120*a* of the second core 120 and the opposing surface 60*a* of the cover 60 are displaced relative to each other in the axial direction (the distance in the axial direction therebetween)) is denoted by L12. In addition, the length t of the gap S and the distances L11 and L12 satisfy a relationship of the following formula (2)'.

$$L12>L11 \quad (2)$$

$$L12-L11=t \quad (2)'$$

In the above oil pump 100, when the cover 60 having the second core 120 held in the holding hole 61 is fixed to the housing 40, in which the first core 110 having the inner rotor 10 and the outer rotor 20 housed in the rotor housing portion 31 is disposed in the recess 41, by fastening the bolts 70, the axial end surface 32*a* of the first core 110 and the axial end surface 120*a* of the second core 120 are brought into contact with each other.

Each of the first core 110 and the second core 120 is formed from a metal. Therefore, in a state where the above contact has occurred, the first core 110 and the second core 120 do not move in the axial direction relative to each other, and thus both cores 110 and 120 are positioned in the axial direction relative to each other. In addition, in a state where the above contact has occurred, the projection 122 provided on the axial end surface 120*a* of the second core 120 is fitted into the cut portion 111 provided on the axial end surface 32*a* of the first core 110, and thus both cores 110 and 120 are positioned in the radial direction and the circumferential direction relative to each other. Moreover, each of the first core 110 and the second core 120 is a cut workpiece subjected to cutting. Therefore, both cores 110 and 120 are more accurately positioned in the axial direction, positioned in the radial direction, and positioned in the circumferential direction.

In a state where the axial end surface 32*a* of the first core 110 and the axial end surface 120*a* of the second core 120 are in contact with each other, the gap S having the length t is formed between the opposing surface 40*a* of the housing 40 and the opposing surface 60*a* of the cover 60. Therefore, contact between the housing 40 and the cover 60 is avoided before the first core 110 and the second core 120 are brought into contact with each other, and thus the accuracy in positioning the first core 110 and the second core 120 relative to each other is enhanced.

When the first core 110 and the second core 120 are positioned in the axial direction, the radial direction, and the circumferential direction relative to each other as described above, variations in volume of the volume chamber 37 within the first core 110 are reduced, and thus a stable discharge amount is ensured. In addition, when the first core 110 and the second core 120 are positioned in the axial direction, the radial direction, and the circumferential direction relative to each other as described above, the accuracy in assembling each component when assembling the oil pump 100 is significantly improved.

Each of the housing 40 and the cover 60 is formed from a resin. Therefore, the weight of the oil pump 100 is reduced as compared to that with a structure in which each of the housing 40 and the cover 60 is formed from a metal. In addition, in a state where the axial end surface 32*a* of the first core 110 and the axial end surface 120*a* of the second core 120 are in contact with each other, the housing 40 and the cover 60 do not come into contact with each other, and thus the housing 40 and the cover 60 do not need to be precisely processed. Therefore, time and effort in manufacturing are saved, and the manufacturing time is shortened.

Accordingly, in the oil pump 100, similar to the oil pump 1 according to the above-described first embodiment, while the weight of the entire oil pump 100 is reduced by forming each of the housing 40 and the cover 60 from a resin, desired accuracy in assembling each component is ensured by the positioning of the first core 110 and the second core 120 in each direction relative to each other. Furthermore, since the opposing surface 40*a* of the housing 40 and the opposing surface 60*a* of the cover 60 have the seal structure, the same advantageous effects as those in the oil pump 1 according to the above-described first embodiment are obtained.

In the oil pump 100, the projection disc portion 121 is formed on the axial end surface 120*a* of the second core 120 in the region including the axial center portion of the axial end surface 120*a* so as to project in the axial direction, and the projection disc portion 121 is fitted to the inner diameter side of the tubular wall 32 of the first core 110 when assembling the first core 110 and the second core 120 to each other. With this structure, the first core 110 and the second core 120 are smoothly and assuredly assembled to each other, and thus the assemblability is improved.

In the above second embodiment, the axial end surface 32*a* of the first core 110 corresponds to "first axial end surface" described in the claims, the axial end surface 120*a* of the second core 120 corresponds to "second axial end surface" described in the claims, the cut portion 111 of the first core 110 corresponds to "first recess/projection portion" described in the claims, and the projection 122 of the second core 120 corresponds to "second recess/projection portion" described in the claims.

Meanwhile, in the above second embodiment, the cut portion 111 is formed on the axial end surface 32*a* of the tubular wall 32 of the first core 110 by cutting a part in the circumferential direction of the tubular wall 32, and the projection 122 is formed on the axial end surface 120*a* of the second core 120 so as to project in the axial direction from a part in the circumferential direction of the outer edge of the second core 120. However, the present invention is not limited thereto. A projection may be formed on the axial end surface 32*a* of the tubular wall 32 of the first core 110 so as to project in the axial direction from a part thereof in the circumferential direction, and a cut portion may be formed on the axial end surface 120*a* of the second core 120 by cutting a part in the circumferential direction of the outer edge of the second core 120. In this case, in order to avoid hindrance of contact between the axial end surface 32*a* of the first core 110 and the axial end surface 120*a* of the second core 120 due to fitting between the projection and the cut portion, that is, in order to prevent occurrence of a situation in which the distal end of the projection presses the bottom surface of the cut portion when fitting the projection thereinto, the depth in the axial direction of the cut portion from the axial end surface 120*a* of the second core 120 is set so as to be not less than the length by which the projection projects in the axial direction from the axial end surface 32*a* of the first core 110. In this modification as well, the same advantageous effects as those in the above second embodiment are obtained.

In the above first and second embodiments, as the seal structure between the opposing surface 40*a* of the housing 40 and the opposing surface 60*a* of the cover 60, the housing 40 side has the recess-like portion 45, which is a groove, and the cover 60 side has the projection-like portion 65, which is a projection. However, the present invention is not limited thereto. The housing 40 side may have a projection-like portion that is a projection, and the cover 60 side may have a recess-like portion that is a groove.

In each of the above first and second embodiments, either one of the first core 30 or 110 and the second core 50 or 120 is formed such that the position in the axial direction of the axial end surface 32*a*, 50*a*, or 120*a* thereof is at the outer side in the axial direction with respect to the opposing surface 40*a* of the housing 40 or the opposing surface 60*a* of the cover 60, and the other core is formed such that the position in the axial direction of the axial end surface 32*a*, 50*a*, or 120*a* thereof is not at the outer side in the axial direction with respect to the opposing surface 60*a* of the cover 60 or the opposing surface 40*a* of the housing 40, that is, is a position recessed from the opposing surface 60*a* of the cover 60 or the opposing surface 40*a* of the housing 40. With this configuration, the core that projects axially outward and the core that is recessed axially inward are assembled to each other while an axially outer portion of the core that projects axially outward is guided by the inner surface of the cover 60 or the housing 40 that holds the core recessed axially inward, and thus the assemblability is improved.

However, the present invention is not limited thereto. Each core may be formed such that the position in the axial direction of the axial end surface 32*a*, 50*a*, or 120*a* thereof is at the outer side in the axial direction with respect to the opposing surface 40*a* of the housing 40 or the opposing surface 60*a* of the cover 60. With this structure as well, after assembling of the oil pump 1 or 100 is completed, a gap S having a length t in the axial direction may be formed between the opposing surface 40*a* of the housing 40 and the opposing surface 60*a* of the cover 60.

Third Embodiment

Similar to the above oil pumps 1 and 100, an oil pump 200 according to a third embodiment is a trochoid type gear pump that pressure-feeds sucked oil. The oil pump 200 is realized by including a first core 210, a second core 220, and a housing 230, instead of the first core 30, the housing 40, the second core 50, and the cover 60 of the oil pump 1, as shown in FIG. 21, FIG. 22, FIG. 23, FIG. 24, and FIG. 25. In the oil pump 200, the same components as those in the oil pump 1 are designated by the same reference numerals, and the description thereof is omitted or simplified.

The first core 210 has the same configuration as the first core 30 except for a later-described portion. The first core 210 has a rotor housing portion 211 and also has a flange portion 212. The rotor housing portion 211 is a space surrounded by a tubular wall 213 having a cylindrical shape and a bottom wall 214 having a disc shape. The rotor housing portion 211 has a volume that allows the inner rotor 10 and the outer rotor 20 to be housed therein. The inner rotor 10 and the outer rotor 20 are housed in the rotor housing portion 211. The rotor housing portion 211 is open at the side axially opposite to the bottom wall 214. The first core 210 is held in the housing 230 in a state where the tubular wall 213 and the bottom wall 214 are housed in a later-described recess 231 of the housing 230. The flange portion 212 is a portion that projects radially outward from an end portion at the opening side in the axial direction of the tubular wall 213. The flange portion 212 has an outer shape corresponding to the outer shape of the housing 230. The flange portion 212 opposes a later-described axial end surface 230*a* of the housing 230 in the axial direction.

The second core 220 has the same configuration as the second core 50 except for a later-described portion. The second core 220 is formed in a board or plate shape corresponding to the outer shape of the housing 230. The second core 220 is formed so as to have a predetermined thickness in the axial direction over the substantially entire area thereof. The second core 220 is disposed so as to be adjacent to the first core 210 in the axial direction. The second core 220 is positioned in contact with the first core 210 in the axial direction and opposes the axial end surface 230*a* of the housing 230 across the first core 210 in the axial direction. The second core 220 closes the opening of the recess 231 of the housing 230 and the opening of the rotor housing portion 211 of the first core 210.

The first core 210 and the second core 220 are in contact with each other, and are also engaged with and fixed to each other in this contact state. The first core 210 has a first contact portion 215 and a first engagement portion 216. The second core 220 has a second contact portion 221 and a second engagement portion 222. The first contact portion 215 is the above flange portion 212. The first contact portion 215 of the first core 210 and the second contact portion 221 of the second core 220 are in contact with each other.

The first engagement portion 216 of the first core 210 and the second engagement portion 222 of the second core 220 are engaged with each other. Each of the first engagement portion 216 and the second engagement portion 222 is a recess portion into which a shared engagement pin 240 is fitted. The first engagement portion 216 is a through hole that is provided in the first contact portion 215 so as to penetrate the first contact portion 215 in the axial direction. The second engagement portion 222 is a groove that is provided on the second contact portion 221 so as to extend in the axial direction and be open. Each of the first engagement portion 216 and the second engagement portion 222 is provided at a plurality of locations (for example, two locations) and disposed at an interval in the circumferential direction. The first core 210 and the second core 220 are engaged with each other in a state where the first contact portion 215 and the second contact portion 221 are in contact with each other, by inserting and fitting the engagement pin 240 into each first engagement portion 216 and each second engagement portion 222. When this engagement is achieved, the first core 210 and the second core 220 are positioned in the radial direction and the circumferential direction relative to each other.

The housing 230 has the same configuration as the housing 40 except for a later-described portion. The housing 230 has the recess 231 in which the first core 210 is disposed and housed. The recess 231 is formed in a shape (specifically, a cylindrical shape) corresponding to the outer shape of the tubular wall 213 of the first core 210. In a state where the bottom wall 214 opposes the bottom wall of the recess 231 and the opening side of the first core 210 faces the opening side of the recess 231, the first core 210 is held such that the tubular wall 213 is housed in the recess 231 and the flange portion 212 opposes the axial end surface 230*a* of the housing 230. The axial end surface 230*a* of the housing 230 is a flange-opposing portion that opposes the flange portion 212 of the first core 210.

The housing 230 has engagement holes 232 into which end portions of the engagement pins 240 are inserted and fitted. The engagement pins 240 are inserted and fitted into the first engagement portions 216 of the first core 210, the second engagement portions 222 of the second core 220, and the engagement holes 232 of the housing 230. When this engagement is achieved, the first core 210, the second core 220, and the housing 230 are positioned in the radial direction and the circumferential direction relative to each other.

When the first core 210, the second core 220, and the housing 230 are positioned relative to each other as described above, the first contact portion 215 of the first core 210 and the second contact portion 221 of the second core 220 are brought into contact with each other, whereas the flange portion 212 of the first core 210 and the axial end surface 230*a* of the housing 230 are not brought into contact with each other. That is, a gap S is formed between the flange portion 212 of the first core 210 and the axial end surface 230*a* of the housing 230. The gap S has a length t in the axial direction.

The first core 210 is formed such that, in a state where the first core 210 is held in the recess 231 of the housing 230, the flange portion 212 protrudes axially outward of the axial end surface 230*a* of the housing 230. In a state where the first core 210 is held in the recess 231 of the housing 230, the position in the axial direction of an opposing surface 212*a*, of the flange portion 212 of the first core 210, which opposes the axial end surface 230*a* of the housing 230, is at the outer side (second core 220 side) in the axial direction with respect to the axial end surface 230*a* of the housing 230.

Figure 27:
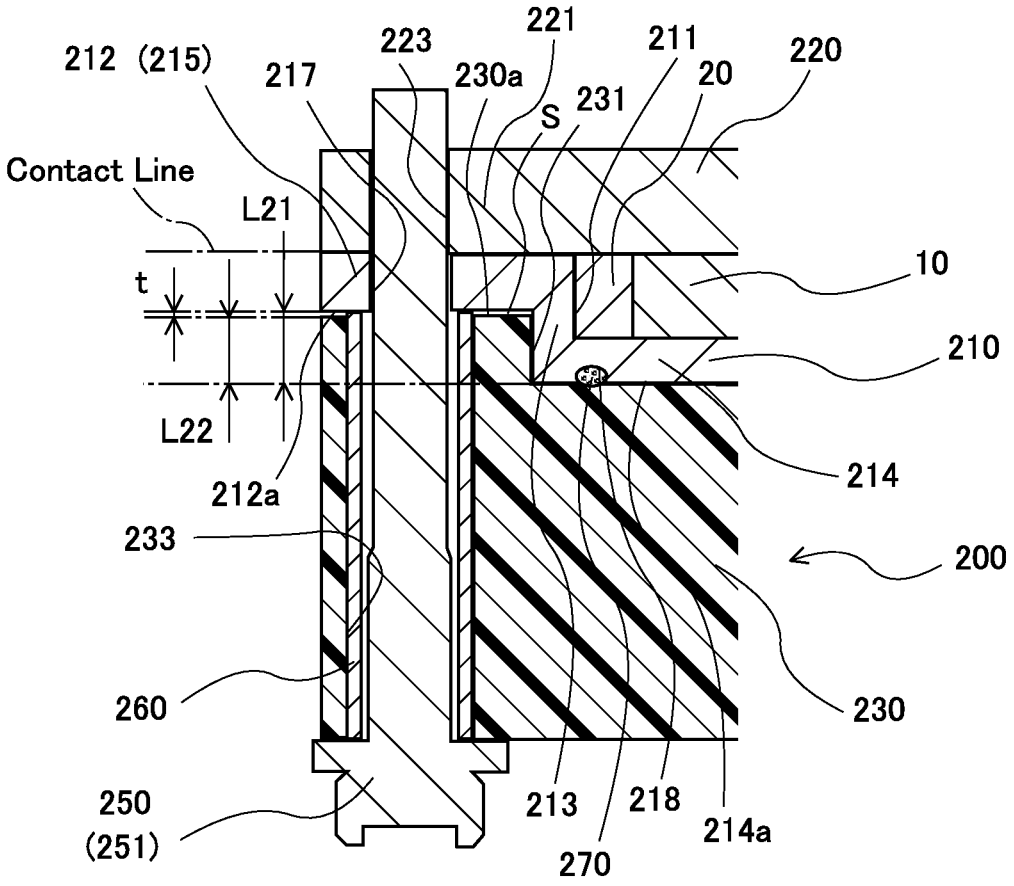
FIG. 27 is an enlarged cross-sectional view of a main part of the oil pump.

That is, as shown in FIG. 27, the first core 210 is formed such that a distance L21 in the axial direction from an opposing surface 214*a*, of the bottom wall 214, which opposes the axial end surface 230*a* of the housing 230 to the opposing surface 212*a* of the flange portion 212 is larger than a distance L22 in the axial direction from the bottom surface of the recess 231 of the housing 230 to the axial end surface 230*a*. The length t in the axial direction of the gap S and the distances L21 and L22 satisfy a relationship of the following formula (3)'.

$$L21-L22=t \quad (3)'$$

The oil pump 200 includes a fastening portion 250. The fastening portion 250 is a portion that fastens the first core 210, the second core 220, and the housing 230. The fastening portion 250 has metallic bolts 251. An external thread is formed on an axial end portion of each bolt 251. The first core 210 has a fastening hole 217 that penetrates the first core 210 in the axial direction and that has a circular cross-section. The fastening hole 217 is provided in the first contact portion 215 of the first core 210. The second core 220 has a fastening hole 223 that penetrates the second core 220 in the axial direction and that has a circular cross-section. The fastening hole 223 is provided in the second contact portion 221 of the second core 220. The housing 230 has a fastening hole 233 that penetrates the housing 23 in the axial direction and that has a circular cross-section. The fastening hole 233 is provided in a portion, of the housing 230, which is located radially outward of the recess 231.

Each of the fastening holes 217 and 233 has a diameter slightly larger than the outer diameter of the shaft portion of the bolt 251. The fastening hole 223 has a diameter substantially equal to the outer diameter of the shaft portion of the bolt 251. An internal thread is formed in the fastening hole 223 of the second core 220. Each of the fastening holes 217, 223, and 233 is provided at a plurality of locations (for example, four locations) in the circumferential direction around the drive shaft 2, and these fastening holes 217, 223, and 233, the numbers of which are equal to each other, are provided at positions corresponding to each other.

The oil pump 200 includes metallic collar members 260. Each collar member 260 is a cylindrical member that is inserted and disposed in the fastening hole 233 of the housing 230. The collar member 260 is formed such that the collar member 260 slightly projects in the axial direction from the opening of the fastening hole 233 of the housing 230 in a fastened state by the fastening portion 250. The length by which the collar member 260 projects in the axial direction from the opening of the fastening hole 233 of the housing 230 is a length equal to that of the above gap S.

The first core 210, the second core 220, and the housing 230 are fastened by, in a state where the first core 210, the second core 220, and the housing 230 are positioned in the radial direction and the circumferential direction relative to each other, inserting each bolt 251 from the fastening hole 233 side of the housing 230 through the interior of the collar member 260 and further through the fastening hole 217 of the first core 210 and the fastening hole 223 of the second core 220 and screwing the bolt 251 to the internal thread of the fastening hole 223. In this fastened state, the flange portion of the bolt 251, the collar member 260, the flange portion 212 (that is, the first contact portion 215) of the first core 210, and the second contact portion 221 of the second core 220 are aligned in the axial direction so as to be in contact with each other.

The oil pump 200 includes a seal member 270. The seal member 270 is disposed at a location where the bottom wall 214 of the rotor housing portion 211 of the first core 210 and the bottom wall of the recess 231 of the housing 230 contact each other. The seal member 270 is a member for ensuring sealing between the first core 210 and the housing 230. The seal member 270 has a function of: preventing the communication groove 35 of the first core 210 and the inflow hole 42 of the housing 230 from communicating with the outside (including the communication groove 36 of the first core 210 and the discharge hole 43 of the housing 230) through the location where the above bottom walls contact each other; and preventing the communication groove 36 of the first core 210 and the discharge hole 43 of the housing 230 from communicating with the outside through the location where the above bottom walls contact each other.

Figure 26:
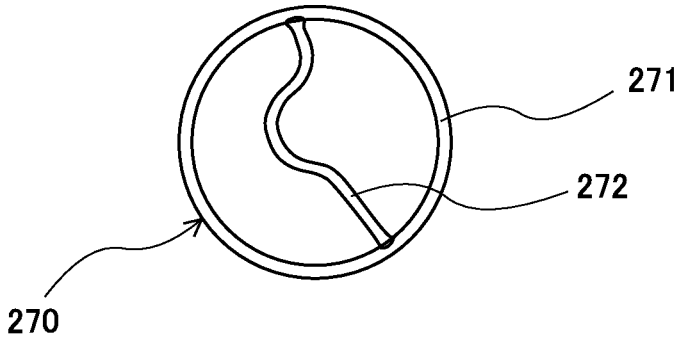
FIG. 26 is a top view of a seal member of the oil pump.

As shown in FIG. 26, the seal member 270 has an annular portion 271 and a partition portion 272. The annular portion 271 is formed in an annular shape. The partition portion 272 is a portion that connects two portions in the circumferential direction of the annular portion 271 and that partitions a region at the side at which the inflow hole 42 of the housing 230 is present (that is, at the side at which the communication groove 35 of the first core 210 is present) and a region at the side at which the discharge hole 43 is present (that is, at the side at which the communication groove 36 of the first core 210 is present). A seal groove 218 is provided on a surface, of the bottom wall 214 of the first core 210, which opposes the bottom wall of the recess 231 of the housing 230. The seal groove 218 is formed so as to match with the seal member 270. The seal member 270 is disposed so as to be fitted into the seal groove 218 of the first core 210.

The oil pump 200 having the above configuration is assembled according to the following procedure. Specifically, first, the drive shaft 2 is inserted into the through hole 51 of the second core 220, the inner rotor 10 is fixed to an axial end portion of the drive shaft 2, and the engagement pins 240 are press-fitted into the second engagement portions 222 of the second core 220.

Next, the second core 220 is placed such that the second core 220 horizontally extends in a state where the axial end portion of the drive shaft 2 and the inner rotor 10 are located above the second core 220, the outer rotor 20 is placed such that the outer rotor 20 meshes with the inner rotor 10, and the first core 210 is assembled to the second core 220 from above. The first core 210 is assembled to the second core 220 such that the flange portion 212 (that is, the first contact portion 215) of the first core 210 and the second contact portion 221 of the second core 220 are in contact with each other in the axial direction and the engagement pins 240 at the second core 220 side are inserted into the first engagement portions 216 of the first core 210.

Subsequently, the seal member 270 is placed in the seal groove 218 of the first core 210, and then the housing 230 is assembled from above. The housing 230 is assembled such that the engagement pins 240 are press-fitted into the engagement holes 232 of the housing 230. Finally, the collar members 260 are inserted and placed in the fastening holes 233 of the housing 230, and then the bolts 251 of the fastening portion 250 are inserted into the fastening holes 233 of the housing 230 (further the collar members 260), the fastening holes 217 of the first core 210, and the fastening holes 223 of the second core 220 and screwed to the internal threads of the fastening holes 223. Accordingly, the oil pump 200 is assembled.

In the above oil pump 200, when the drive shaft 2 rotates, the inner rotor 10, which forms the trochoid within the rotor housing portion 211 of the first core 210, rotates relative to the outer rotor 20. During the rotation, when the internal pressure of the volume chamber 37 within the rotor housing portion 211 of the first core 210 becomes negative due to an increase in volume of the volume chamber 37, the oil is sucked from the inflow hole 42 into the volume chamber 37. Thereafter, when the internal pressure of the volume chamber 37 rises due to a decrease in volume of the volume chamber 37 caused by the rotation of the trochoid, the oil sucked into the volume chamber 37 is introduced to the discharge hole 43 and discharged to the outside. When this pumping action is continuously performed by the rotation of the trochoid, the oil is pressure-fed from the oil pump 200.

When the oil pump 200 is assembled as described above, the flange portion of each bolt 251, each collar member 260, the flange portion 212 (that is, the first contact portion 215) of the first core 210, and the second contact portion 221 of the second core 220 are aligned in the axial direction so as to be in contact with each other. Each bolt 251, each collar member 260, the first core 210, and the second core 220 are each formed from a metal. Therefore, in the above contact state, the first core 210 and the second core 220 do not move in the axial direction relative to each other, and thus both cores 210 and 220 are positioned in the axial direction relative to each other. In addition, in this contact state, both cores 210 and 220 are engaged with each other via the engagement pins 240. Thus, both cores 210 and 220 are positioned in the radial direction and the circumferential direction relative to each other. Moreover, each of the first core 210 and the second core 220 is a cut workpiece subjected to cutting. Therefore, both cores 210 and 220 are more accurately positioned in the axial direction, positioned in the radial direction, and positioned in the circumferential direction.

In a state where the first contact portion 215 of the first core 210 and the second contact portion 221 of the second core 220 are in contact with each other, the gap S having the length t in the axial direction is formed between the axial end surface 230*a* of the housing 230 and the first contact portion 215 of the first core 210. Therefore, contact between the housing 230 and the first core 210 in a state where the first core 210 and the second core 220 are in contact with each other is avoided, and thus the accuracy in positioning the first core 210 and the second core 220 relative to each other is enhanced.

When the first core 210 and the second core 220 are positioned in the axial direction, the radial direction, and the circumferential direction relative to each other as described above, variations in volume of the volume chamber 37 within the first core 210, in which the inner rotor 10 and the outer rotor 20 are housed, are reduced, and thus a stable discharge amount is ensured. In addition, when the first core 210 and the second core 220 are positioned in the axial direction, the radial direction, and the circumferential direction relative to each other as described above, the accuracy in assembling each component when assembling the oil pump 200 is significantly improved.

The housing 230 is formed from a resin. Therefore, the weight of the oil pump 200 is reduced as compared to that with a structure in which the housing 230 is formed from a metal. In addition, in a state where the first contact portion 215 of the first core 210 and the second contact portion 221 of the second core 220 are in contact with each other, the axial end surface 230*a* of the housing 230 does not need to be brought into contact with the first contact portion 215 of the first core 210. Thus, the housing 230 does not need to be precisely processed. Therefore, time and effort in manufacturing are saved, and the manufacturing time is shortened.

Accordingly, in the oil pump 200, while the weight of the entire oil pump 200 is reduced by forming the housing 230 from a resin, the accuracy in assembling each component is ensured by the positioning of the first core 210 and the second core 220 in each direction relative to each other.

In the oil pump 200, in a state where the first contact portion 215 of the first core 210 and the second contact portion 221 of the second core 220 are in contact with each other, the first core 210, the second core 220, and the housing 230 are fastened and fixed to each other by using the bolts 251 and the collar members 260 inserted into the fastening holes 217 and 223 provided in these contact portions 215 and 221 and the fastening holes 233 of the housing 230. With this structure, the bolt fastening is achieved at a portion where the first core 210 and the second core 220 are in contact with each other (within a contact range), and thus the sealing is improved. In addition, each collar member 260 is a metallic member that projects in the axial direction from the opening of the fastening hole 233 of the housing 230 by a length equal to that of the above gap S. The above bolt fastening is achieved by using the collar members 260. Thus, tightening of the bolts 251 is accurately managed.

In the oil pump 200, the seal member 270 for ensuring sealing between the first core 210 and the housing 230 is disposed at the location where the bottom wall 214 of the rotor housing portion 211 of the first core 210 and the bottom wall of the recess 231 of the housing 230 contact each other. The seal member 270 has the annular portion 271 and the partition portion 272, prevents the communication groove 35 of the first core 210 and the inflow hole 42 of the housing 230 from communicating with the outside through the location where the above bottom walls contact each other, and prevents the communication groove 36 of the first core 210 and the discharge hole 43 of the housing 230 from communicating with the outside through the location where the above bottom walls contact each other. Thus, oil leak from each portion of the oil pump 200 is inhibited, and rotation of the inner rotor 10 is prevented from being hampered.

Figure 28:
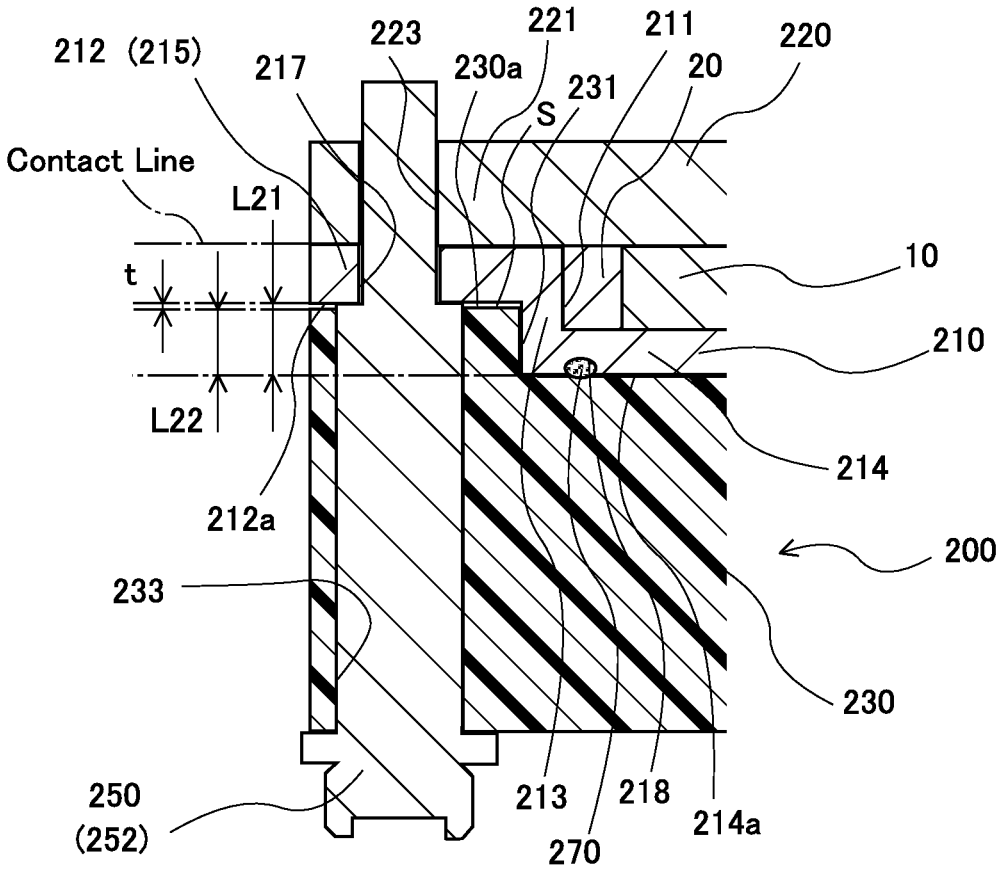
FIG. 28 is an enlarged cross-sectional view of a main part of an oil pump according to a modification.

Meanwhile, in the above third embodiment, the collar members 260 are used together with the bolts 251 for fastening the first core 210, the second core 220, and the housing 230. However, the present invention is not limited thereto, and no collar member may be used as shown in FIG. 28. In this modification, the number of components that form the oil pump 200 is reduced, and assembling of the oil pump 200 is simplified. In addition, in this case, bolts 252 each having a step formed on a shaft portion thereof may be used instead of the bolts 251 each having no step on the shaft portion thereof.

In the above third embodiment, the engagement pins 240, which are fitted into the first engagement portions 216 of the first core 210 and the second engagement portions 222 of the second core 220, are used for positioning the first core 210 and the second core 220 relative to each other when assembling the oil pump 200, and the engagement pins 240 are included in the assembled oil pump 200. However, the present invention is not limited thereto, and the housing 230 and the second core 220 may be formed such that the engagement pins 240 are pulled out from the assembled oil pump 200. In this modification, the components required when assembling the oil pump 200 are removed after assembling, and thus the weight of the oil pump 200 is reduced.

In the above third embodiment, the first engagement portions 216, which are through holes provided in the first contact portion 215 of the first core 210, the second engagement portions 222, which are through holes provided in the second contact portion 221 of the second core 220, and the engagement pins 240, which are fitted into these engagement portions 216 and 222, are used for positioning the first core 210 and the second core 220 relative to each other. However, the present invention is not limited thereto, and a recess may be provided on the contact portion 215 or 221 of one of the first core 210 and the second core 220 so as to be recessed in the axial direction, and a projection to be fitted into this recess may be provided on the contact portion 215 or 221 of the other core so as to project in the axial direction.

The present invention is not limited to the embodiments and modifications described above, and various changes may be made without departing from the gist of the present invention.

This application claims priority on Japanese Patent Application No. 2018-163625 filed in Japan on Aug. 31, 2018 and Japanese Patent Application No. 2019-086356 filed in Japan on Apr. 26, 2019, the entire contents of which are incorporated herein by reference.

The invention claimed is:

1. An oil pump comprising:

an inner rotor having external teeth;

an outer rotor having an inner rotor housing portion in which the inner rotor is rotatably housed in an eccentric state, and internal teeth that mesh with the external teeth;

a tubular first core having a rotor housing portion in which the inner rotor and the outer rotor are housed, and a flange portion that projects radially outward from a tubular wall forming the rotor housing portion;

a housing made of a resin and having a recess in which the first core is held and a flange-opposing portion that opposes the flange portion of the first core; and a board-shaped second core disposed in contact with the first core in an axial direction and closing an opening of the rotor housing portion, wherein the first core has a first contact portion that is in contact with the second core and a first engagement portion that is engaged with the second core in a state where the first contact portion is in contact with the second core, the second core has a second contact portion that is in contact with the first core and a second engagement portion that is engaged with the first core in a state where the second contact portion is in contact with the first core, and the oil pump has a gap formed between the flange portion of the first core and the flange-opposing portion of the housing in a state where the first contact portion and the second contact portion are in contact with each other.

2. The oil pump according to claim 1, wherein the first engagement portion and the second engagement portion are portions having a recess and a projection fitted to each other, or are recessed portions into which a shared engagement pin is fitted.

3. The oil pump according to claim 1, further comprising a fastening portion that fastens the first core, the second core, and the housing within a range where the first contact portion and the second contact portion are in contact with each other.

4. The oil pump according to claim 3, further comprising a collar that is inserted into a fastening hole of the housing and that projects in the axial direction from an opening of the fastening hole in the flange-opposing portion by a length equal to that of the gap.

5. The oil pump according to claim 1, further comprising a seal disposed at a location where a bottom wall of the rotor housing portion of the first core and a bottom wall of the recess of the housing contact each other.

6. The oil pump according to claim 1, wherein each of the first core and the second core is a cut workpiece formed from a metal or a thermosetting resin.

7. A method for assembling an oil pump, the oil pump comprising:

an inner rotor having external teeth;

an outer rotor having an inner rotor housing portion in which the inner rotor is rotatably housed in an eccentric state, and internal teeth that mesh with the external teeth;

a tubular first core having a rotor housing portion in which the inner rotor and the outer rotor are housed, and a flange portion that projects radially outward from a tubular wall forming the rotor housing portion;

a housing made of a resin and having a recess in which the first core is held and a flange-opposing portion that opposes the flange portion of the first core; and a board-shaped second core disposed in contact with the first core in an axial direction and closing an opening of the rotor housing portion, wherein the first core has a first contact portion that is in contact with the second core and a first engagement portion that is engaged with the second core in a state where the first contact portion is in contact with the second core, the second core has a second contact portion that is in contact with the first core and a second engagement portion that is engaged with the first core in a state where the second contact portion is in contact with the first core, and the oil pump has a gap formed between the flange portion of the first core and the flange-opposing portion of the housing in a state where the first contact portion and the second contact portion are in contact with each other, the method comprising:

a first step of assembling the first core to the second core placed with a contact side thereof with the first core located at an upper side, from above, such that the first contact portion and the second contact portion are brought into contact with each other and the first engagement portion and the second engagement portion are brought into engagement with each other; and a second step of assembling the housing to the first core that has been assembled to the second core, from above, such that the first core is held in the recess and the flange portion of the first core opposes the flange-opposing portion.

* * * * *